US005425429A

United States Patent [19]

Thompson

[11] Patent Number: 5,425,429

[45] Date of Patent: Jun. 20, 1995

[54] METHOD AND APPARATUS FOR FORMING LATERAL BOREHOLES

[76] Inventor: Michael C. Thompson, 520 S. Ridge St., Southern Pines, N.C. 28387

[21] Appl. No.: 261,854

[22] Filed: Jun. 16, 1994

[51] Int. Cl.[6] ..... E21B 7/04

[52] U.S. Cl. ..... 175/62; 175/77; 175/78

[58] Field of Search ..... 175/62, 61, 73–78, 175/257–259

[56] References Cited

U.S. PATENT DOCUMENTS

| | | | |
|---|---|---|---|
| 2,044,648 | 6/1936 | Stevens . | |
| 2,251,916 | 8/1941 | Cross . | |
| 2,550,408 | 4/1951 | Fehlmann . | |
| 3,338,306 | 8/1967 | Cook . | |
| 3,797,576 | 3/1974 | Azalbert et al. . | |
| 4,074,779 | 2/1978 | Cheung et al. . | |
| 4,160,481 | 7/1979 | Turk et al. . | |
| 4,257,650 | 3/1981 | Allen . | |
| 4,317,492 | 3/1982 | Summers et al. . | |
| 4,353,417 | 10/1982 | Widmyer . | |
| 4,365,676 | 12/1982 | Boyadjieff et al. . | |
| 4,421,183 | 12/1983 | Collins, Jr. . | |
| 4,434,849 | 3/1984 | Allen . | |
| 4,497,381 | 2/1985 | Dickinson, III et al. . | |
| 4,558,750 | 12/1985 | Burton et al. . | |
| 4,600,061 | 7/1986 | Richards . | |
| 4,621,691 | 11/1986 | Schuh . | |
| 4,640,353 | 2/1987 | Schuh . | |
| 4,646,836 | 3/1987 | Goodhart . | |
| 4,762,186 | 8/1988 | Dech et al. . | |
| 4,763,734 | 8/1988 | Dickinson et al. . | |
| 5,033,556 | 7/1991 | Panzke . | |
| 5,133,418 | 7/1992 | Gibson et al. | 175/62 X |
| 5,139,094 | 8/1992 | Prevedel . | |
| 5,148,875 | 9/1992 | Karlsson et al. . | |
| 5,148,877 | 9/1992 | MacGregor . | |
| 5,165,491 | 11/1992 | Wilson . | |
| 5,211,510 | 5/1993 | Kimura et al. | 175/62 X |
| 5,255,750 | 10/1993 | Wilkes, Jr. et al. . | |

FOREIGN PATENT DOCUMENTS

| | | |
|---|---|---|
| 1268783 | 6/1961 | France . |
| 2066333 | 7/1981 | United Kingdom . |
| 0857462 | 8/1981 | U.S.S.R. . |
| 1004598A | 3/1983 | U.S.S.R. . |

OTHER PUBLICATIONS

*The ABC's of Oil,* Jerry Robertson, 1953, pp. 27–28, 35, 37–39, 52–53.

*Primary Examiner*—Michael Powell Buiz
*Attorney, Agent, or Firm*—John B. Phillips; John R. Ley

[57] ABSTRACT

A method for forming substantially lateral boreholes from within an existing elongated shaft includes positioning a drilling unit within the existing shaft, bracing the drilling unit against a wall surrounding the existing shaft to transmit forces between the drilling unit and the medium surrounding the wall, and applying a drilling force from the drilling unit to cut through the wall of the existing shaft and form the substantially lateral borehole in the surrounding medium. A preferred apparatus for practicing the method includes an extendable insert ram within the drilling unit for extending a drill bit from the drilling unit and applying a drilling force to the drill bit to cut through the wall of the existing shaft. A supply of modular drill string elements are cyclically inserted between the insert ram and the drill bit so that repeated extensions of the insert ram further extends the drill bit into the surrounding medium to increase the length of the lateral borehole. The insert ram may also be used to engage and retract the module drill string elements from the borehole once the borehole has been completed. The drilling unit also includes a supply of modular liner elements which the insert ram may insert into the lateral borehole to line the borehole after the drill string elements have been withdrawn from the borehole.

35 Claims, 11 Drawing Sheets

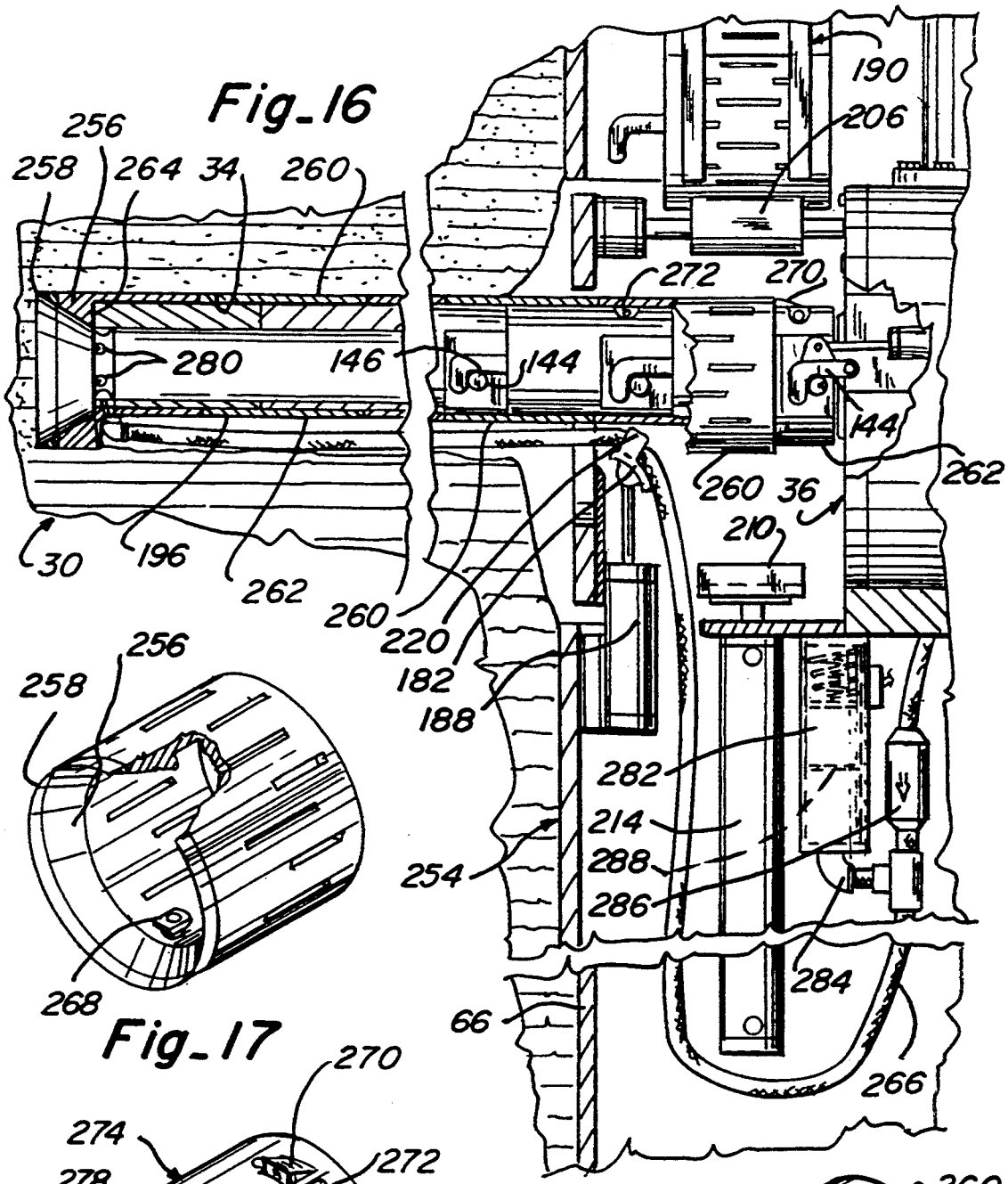
Fig_16
Fig_17
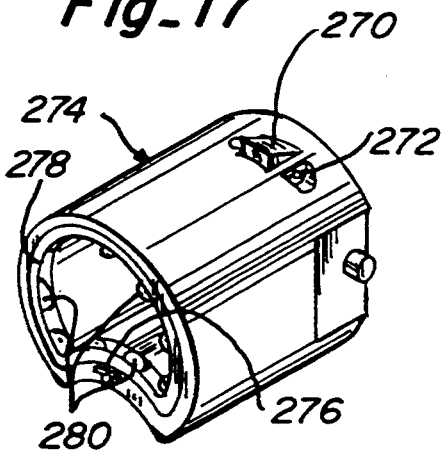
Fig_18
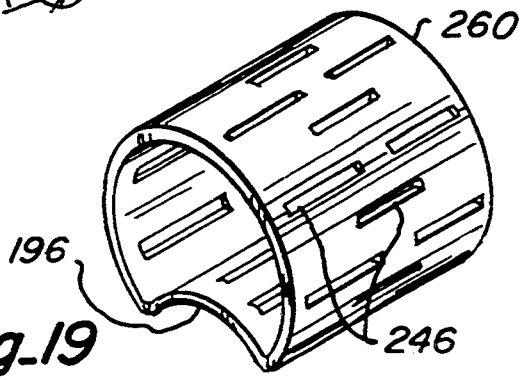
Fig_19

METHOD AND APPARATUS FOR FORMING LATERAL BOREHOLES

FIELD OF THE INVENTION

The present invention relates generally to methods and apparatus for drilling boreholes and, more particularly, the present invention relates to forming lateral boreholes from within a substantially vertical hole, such as an oil well, through the use of opposing forces.

BACKGROUND OF THE INVENTION

The art of drilling vertical holes such as oil wells has traditionally utilized a cutting head driven by a linear series of connected pipe lengths, wherein the drilling fluid needed for lubricating and cooling the drill bit passes through the pipe. The weight-on-bit required to cut through the formation is generated from the weight of a drill string. The maximum force which may be generated by such a system is limited by the allowable stresses in the drill string as it acts as a structural column to translate the drilling force to the drill bit.

It is well known in the art of oil drilling that oil deposits may be very difficult to recover through the type of conventional vertical drilling described above due to the tendency of oil deposits to be restricted to narrow "pay" zones which might only be found thousands of feet below the surface. Due to the small diameter of most unmanned oil wells, it is not uncommon for there to be a limited area of exposure of the vertical well to the oil bearing zone. It has been found that the oil recovery rate of these wells can be dramatically increased by forming lateral boreholes which extend from the existing vertical well at an elevation equal to the level of the oil bearing "pay" zone. However, the prior art methods of forming lateral bore holes from within an existing vertical shaft are inadequate for a variety of reasons.

One prior art method of drilling laterally consists of using a flexible drill string such as those shown in U.S. Pat. No. 5,148,875 to Karlsson et al. and U.S. Pat. No. 5,148,877 to MacGregor. These flexible drill strings transfer rotary and compressive forces from the surface to drive the drill bit and cause it to engage the formation being drilled. However, the force these drill strings can apply to the drill bits is limited by the compressive strength of the drill string. Additionally, flexible drill strings typically require a large turning radius when shifting from a vertical to a horizontal direction. This large turning radius makes it difficult, if not impossible, to accurately target the potentially thin oil zone since the drill string must begin its turn at a point well above the target zone. A further problem with flexible drill strings is their tendency to impact the sides of the drilled hole as gravity pulls the string toward the outside of its turn radius. Impacting the side of the hole leads to excessive wear and may cause irreparable damage to the string.

A further method for drilling lateral holes utilizes a self-propelled drilling unit as shown in U.S. Pat. No. 4,365,676 to Boyadjieff et al. The self-contained drilling unit is lowered to a desired level within a vertical hole prior to being activated. The self-propelled unit includes a gripping structure adapted to engage the sidewall of the hole being drilled to thereby transmit the reactive forces of the drilling operation to the sidewall. The unit further contains means for advancing the drill bit relative to the gripping structure to maintain the bit engaged with the formation. However, the self-contained nature of the drilling unit necessarily limits the maximum weight-on-bit which it can generate and may prevent it from developing sufficient force to penetrate hard rock. Furthermore, since the gripping structures only grip the sidewalls of the newly formed lateral borehole, the self-propelled unit may be ineffective in unconsolidated soils since the soil would not provide adequate support to properly brace the drilling unit.

To develop sufficient force for drilling through rock, it is desirable to brace the drill bit against an anchor that will resist the reactive forces developed by the bit, such as the back wall of an existing vertical shaft. This shaft is often lined and thus may better support the reactive drilling forces. One reference showing such a system is U.S. Pat. No. 4,600,061 to Richards which utilizes a manned platform that is lowered into the vertical shaft so that the men thereon may drill the lateral boreholes. However, such a method could not be used with existing vertical oil wells which typically have a diameter on the order of one foot. Furthermore, such a method would place the men on the platform at great personal risk.

It is with regard to this background information that the improvements available from the present invention have evolved.

SUMMARY OF THE INVENTION

The present invention is embodied in a method and apparatus for forming boreholes from within existing shafts. The existing shaft is typically formed in a surrounding medium and defines a wall in the medium which surrounds the shaft. The preferred method of the present invention places a boring or drilling unit at a predetermined point within the existing shaft and braces the unit against the wall of the shaft so that forces generated by the drilling unit are transmitted to the wall and from there to the surrounding medium. Once the unit is properly braced against the wall, the unit may apply a drilling force to penetrate the wall of the shaft and form the borehole in the surrounding medium.

One preferred embodiment of the present invention forms a substantially lateral borehole from within a substantially vertical shaft such as an oil well. The preferred method includes lowering the drilling unit to a predetermined depth within the vertical shaft, bracing the unit against the shaft wall, extending a drill string from the drilling unit and applying a drilling force to the drill string to cut through the wall of the vertical shaft. The drill string may then be further extended into the surrounding medium to increase the length of the borehole. Additionally, the drill string may be withdrawn from the borehole once the borehole is completed. Furthermore, to prevent the borehole from collapsing upon itself, the drilling unit may be used to insert a liner into the borehole following the withdrawal of the drill string.

Due to the relatively small diameter of most oil wells, a preferred apparatus for practicing the method of the present invention includes modular drill string and liner elements. A telescopically extendable insert ram within the drilling module is preferably used to insert and retract both the drill string modules and the liner modules. The modular drill string is constructed by cyclically extending the insert ram to extend the drill string, retracting the insert ram, loading a drill string module between the insert ram and a rear end of the drill string and again extending the insert ram to further extend the drill string. The drill string preferably includes a known drill bit or cutting head at its leading end to enhance the ability of the drill string to penetrate the shaft wall and the surrounding medium. The insert ram also includes means for engaging the individual drill string modules so that it may retract the drill string one module at a time and store the modules within the drilling unit upon completion of the borehole. The insert ram may then insert the liner modules within the vacated borehole in a manner similar to that described above with respect to the drill string modules.

In an alternative embodiment, the drill string modules and liner modules are inserted simultaneously into the borehole behind the cutting head. In order to simultaneously insert the drill string and liner modules, the drill string modules are preferably inserted within the liner modules before they are loaded between the insert ram and the cutting head. In this manner, after completion of the borehole, the cutting head and liner modules are left behind within the borehole while the insert ram retracts the drilling modules through the liner and stores them one at a time within the drilling unit. This alternative embodiment of the drilling unit may be used in unconsolidated soils which would not allow for the separate withdrawal of the drill string followed by the insertion of a liner.

A further embodiment of the present invention may be utilized to sample or core the surrounding medium beyond the vertical shaft. To take a core sample, the drilling unit extends a coring bit through the wall of the vertical shaft so that the coring bit retains a sample of the surrounding medium. The insert ram would then retract the coring bit within the drilling module so that the core sample may be analyzed once the drilling unit is returned to the surface.

The drilling unit is maneuvered within the vertical shaft in a known manner utilizing conventional drilling pipe to lower the drilling unit from the surface. Drilling mud supplied to the drilling unit through the pipe is preferably used to power hydraulic systems within the drilling unit. These hydraulic systems are used for bracing the drilling unit within the vertical shaft and for operating the insert ram and the drill bit. The hydraulic systems also operate additional apparatus for manipulating and directing the modular drill string and liner elements within the drilling unit. A control system within the drilling unit preferably directs the hydraulic systems and is remotely operated from the surface via radio signals or an umbilical cord running between the drilling unit and a surface control station.

Although the present invention preferably forms lateral boreholes from within existing vertical shafts, angled boreholes may be formed by angling the insert ram (either up or down) from its preferred horizontal axis. Such "off-axis" capability is useful for precisely targeting the borehole within the surrounding medium.

The present invention is superior to prior art lateral drilling methods such as the flexible drill strings described above. In addition to allowing for precise targeting of the borehole, the method and apparatus of the present invention generates relatively large drilling forces by bracing the drilling unit against the wall of the existing shaft. In this manner, the large hydraulic forces generated by the insert ram are directly countered by the strength of the formation of the surrounding medium. Additionally, the self-contained drilling unit does not harm the existing vertical shaft and is designed to be used with known and available support equipment. Lastly, the present invention makes maximum use of reusable components, such as the modular drill string which is withdrawn from the borehole, to reduce the cost and increase the efficiency of forming the lateral boreholes. Thus, the method and apparatus of the present invention may be efficiently used, for example, in the oil industry to recover deposits from previously abandoned wells.

A more complete appreciation of the present invention and its scope can be obtained from understanding the accompanying drawing, which is briefly summarized below, the following detailed description of presently preferred embodiments of the invention, and the appended claims.

BRIEF DESCRIPTION OF THE DRAWINGS

FIG. 16 is a fragmented cross-sectional view illustrating a second embodiment of the invention shown in FIGS. 1–15.

FIG. 17 is a fragmented isometric view of a cutting head used with the second embodiment of the invention shown in FIG. 16.

FIG. 18 is an isometric view of a leading shim having an inner orifice ring for use with the second embodiment of the invention shown in FIG. 16.

FIG. 19 is an isometric view of a liner member used with the second embodiment of the invention shown in FIG. 16.

DETAILED DESCRIPTION OF THE PREFERRED EMBODIMENTS

Figure 1:
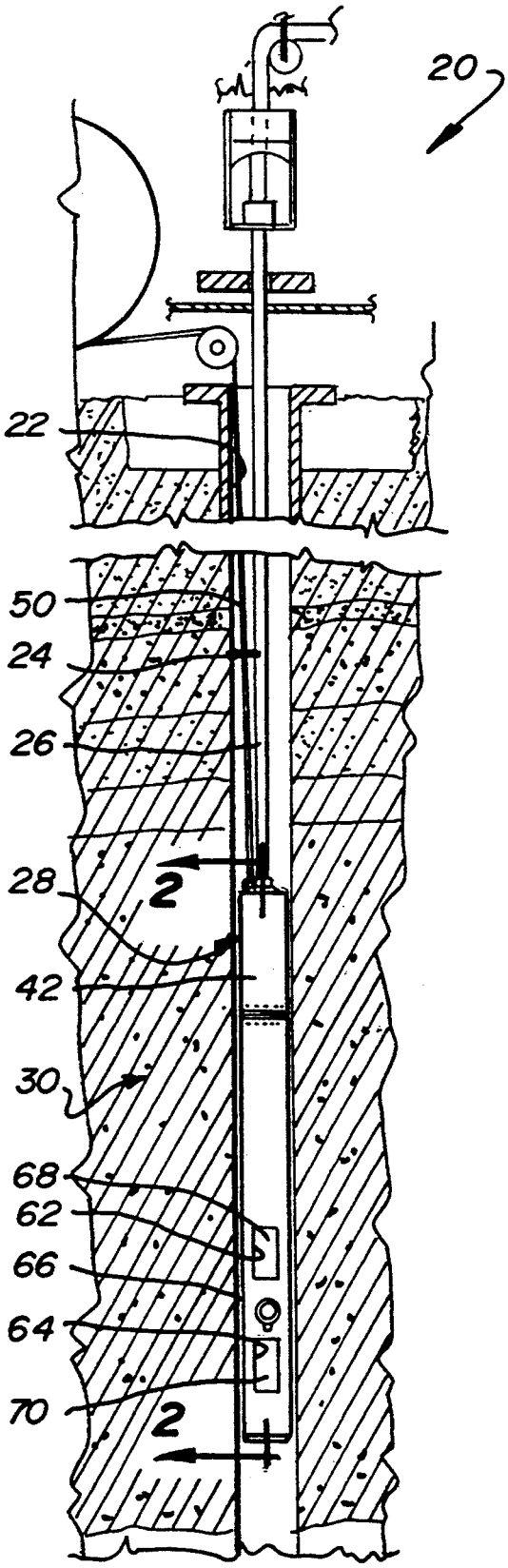
FIG. 1 is a vertical fragmented cross-section of an oil well showing the apparatus of the present invention positioned within the oil well adjacent an oil bearing layer of the earth.

FIG. 1 illustrates a first embodiment of the present invention used in conjunction with a typical oil well 20. The oil well 20 comprises a vertical shaft 22 which would typically be formed by a rotary drill bit (not shown) attached to the end of a drill string 24 that is made up of a series of connected lengths of drill pipe 26. Fluid "drilling mud" pumped through the drill pipes 26 of the drill string 24 would be used to cool and lubricate the drill bit and would then flow to the surface carrying the tailings excavated from the area in front of the drill bit. The apparatus of the present invention is preferably used in conjunction with this prior art equipment to enhance oil recovery by creating a larger infiltration surface area in the oil zone.

The apparatus of the present invention preferably includes a cylindrical vessel 28 which is lowered by standard drill pipe into the vertical shaft 22 of the oil well 20. The oil well may be newly formed or it may constitute an existing well. The vertical shafts 22 of wells are typically lined after boring to prevent the shaft from collapsing in upon itself and also to prevent salt water zones and drilling mud within the shaft from contaminating adjacent fresh water zones. The shaft 22 forms an interior surface with an inner diameter typically in the range of 12–14 inches, and may be lined to form an inner diameter typically in the range of 6–7 inches. These dimensions thus define the maximum and minimum diameters of the cylindrical vessel 28 which may vary in size to fit different oil wells.

Figure 3:
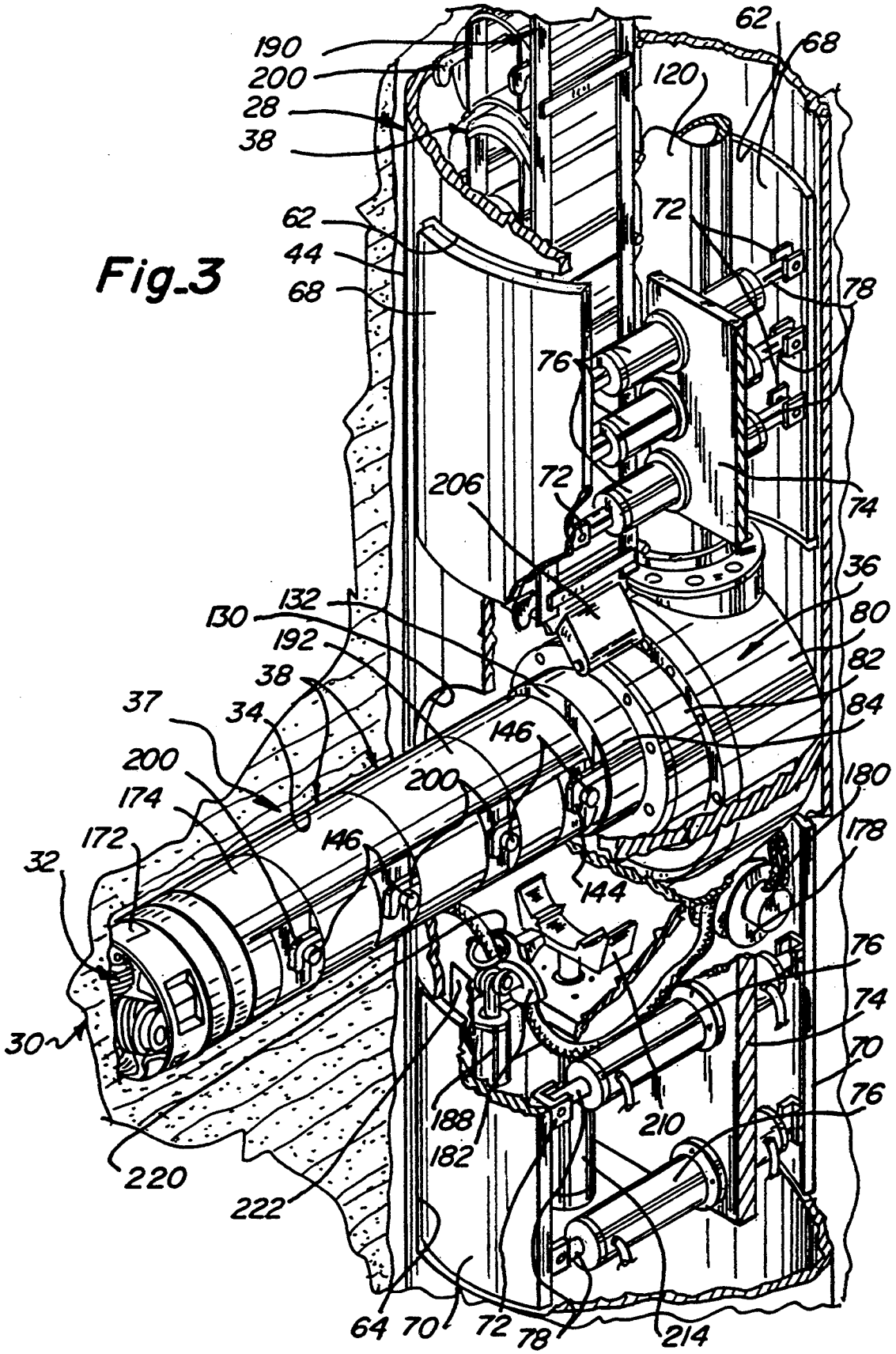
FIG. 3 is an enlarged fragmented isometric view of the apparatus as shown in FIGS. 1 and 2, illustrating a drilling head forming a lateral bore hole.
Figure 5:
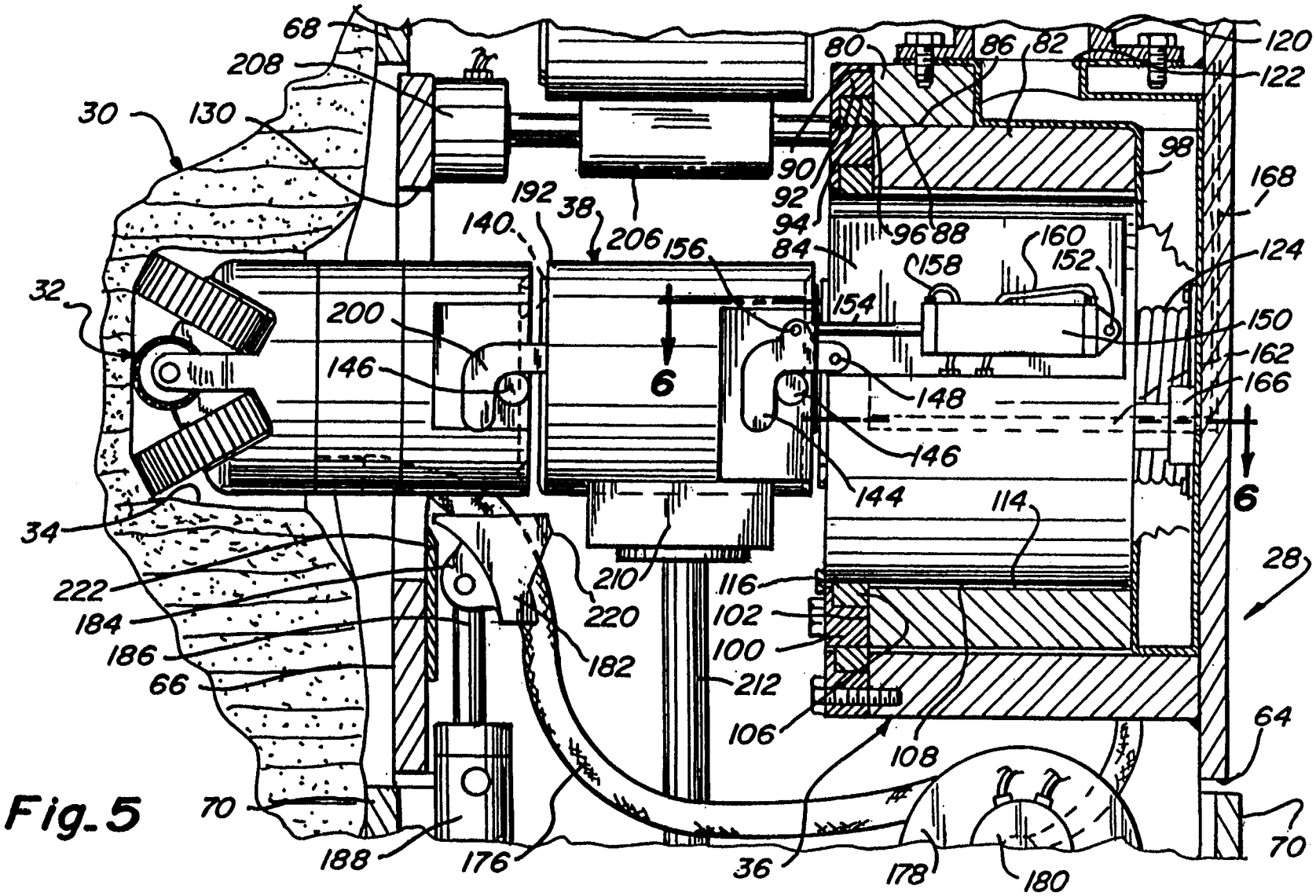
FIG. 5 is a section taken substantially in the plane of line 5—5 of FIG. 6, showing the drill bit in operation.

The vessel 28 is lowered to a depth which is believed to be adjacent to an oil bearing "pay" zone 30. Once the vessel 28 is anchored in place within the vertical shaft 22, it operates a drill bit (a rotary drill bit 32 for earthen excavation is shown in FIGS. 3 and 5) to form a substantially lateral or horizontal borehole 34 which extends from the existing vertical shaft into the pay zone 30. Of course, a different drill bit (not shown) may be required if it is necessary to cut through the liner of the vertical shaft prior to forming the lateral borehole 34 with the rotary drill bit 32.

The drill bit 32 is inserted laterally within the pay zone 30 by an insert ram 36 within the vessel 28. A preferably modular drill string 37 consisting of a plurality of shims 38 is then utilized in conjunction with the insert ram 36 as described below to insert the drill bit 32 further within the pay zone 30. While the preferred embodiment of the present invention utilizes a modular drill string 37 and a conventional drill bit 32, it is to be understood that other types of drill strings (e.g., non-modular) and drill bits may be advantageously used with the present invention.

The insert ram 36 alternately extends to push the drill bit further into the pay zone 30 and then retracts to load a shim 38 between the ram and the drill bit 32. The shim 38 allows the insert ram 36 to be extended again to push the drill bit 32 further into the pay zone a distance equivalent to the length of the shim. By using a plurality of shims 38, the insert ram 36 may be extended repeatedly to push the drill bit 32 and modular drill string 37 a predetermined distance into the pay zone 30, thereby forming the lateral borehole 34. The vessel 28 may also be used to line the new lateral borehole 34, thereby preventing the borehole from collapsing while allowing oil within the pay zone 30 to flow through the lateral borehole and into the existing vertical shaft 22 where it may be pumped to the surface in a known manner.

The vessel 28 is divided into two sections (FIG. 2) which are separated by a horizontal bulkhead 40. An upper control module 42 contains power generating and monitoring equipment and is sealed to allow the vessel 28 to function while completely immersed in fluid. A lower drilling module 44 contains the remainder of the drilling equipment and is necessarily open at its bottom end to the environment within the shaft 22.

Figure 2:
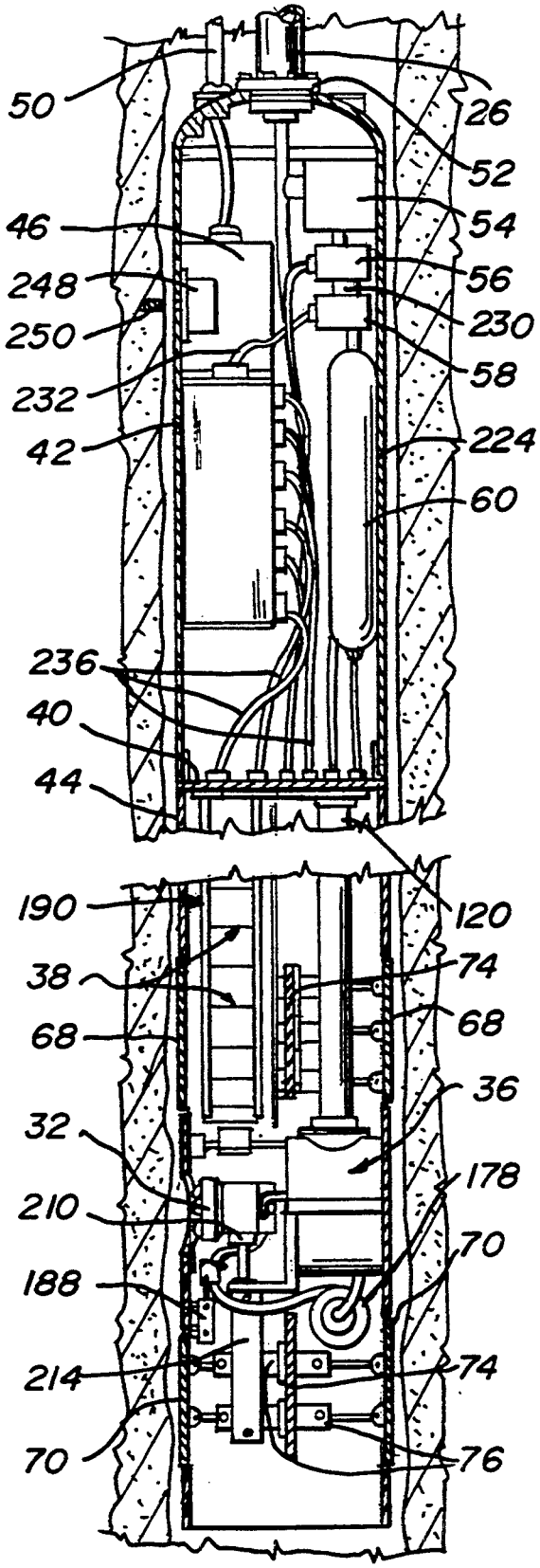
FIG. 2 is an enlarged section taken substantially in the plane of line 2—2 of FIG. 1.

As shown in FIGS. 1 and 2, a known control system 46 within the control module 42 is connected to an up-hole monitor and control station 48 via an umbilical cord 50. In place of the umbilical cord 50, a known wireless (i.e., radio) telemetry system (not shown) may be used to communicate between the control system 46 and the up-hole control station 48. The umbilical cord 50 carries information between the control system 46 in the control module 42 and the up-hole station which includes an operator control interface. While the umbilical cord 50 is capable of supplying electrical power to operate the control module 42, a majority of the operations of the vessel 28 are preferably performed hydraulically.

In addition to the control system 46, the control module 42 contains all the elements of the hydraulic power system. A sealed fitting 52 within the control module 42 allows the high pressure drilling mud within the string 24 of drill pipes 26 to operate a turbine 54 within the control module. The turbine 54, in turn, operates hydraulic pumps 56 and 58 which pump hydraulic fluid from a reservoir 60 within the control module 42 to the separate systems within the drilling module 44, as described in greater detail below.

The drilling module 44 includes two pairs of openings 62 and 64 formed in an outer casing 66 of the vessel 28, as shown in FIGS. 1 and 3. Each pair of openings is substantially rectangular in shape, with the two openings in each pair being diametrically opposed to one another. The upper openings 62 are adapted to receive a matched pair of upper anchor shoes 68, while the lower openings 64 similarly receive a pair of lower anchor shoes 70, as shown best in FIG. 3. The anchor shoes preferably comprise either curved steel plates (for use in an unlined vertical shaft) or rubber pads (for use in steel-lined vertical shafts). An inner surface of each anchor shoe includes a plurality of mounting brackets 72, as shown in FIG. 3.

Vertical bulkheads 74 are preferably fixed within the drilling module 44 midway between the opposing openings of each pair of openings 62 and 64. A plurality of hydraulic cylinders 76 are fixed to both sides of the vertical bulkheads 74 and are preferably aligned vertically as shown in FIG. 3. A piston (not shown) within the cylinders 76 drives a piston rod 78, and a free end of each piston rod 78 is received within one of the mounting brackets 72 on the inner surface of the anchor shoes. In this manner, the hydraulic cylinders 76 may move the upper and lower anchor shoes 68 and 70 from a retracted position within the drilling module 44 to an extended position through the openings 62 and 64, respectively, and past the outer casing 66 to a position outside of the drilling module.

The anchor shoes are used to fix the vessel 28 in a desired position within the vertical shaft 22. As the vessel is lowered within the vertical shaft, the anchor shoes 68 and 70 are retracted within the outer casing 66 of the drilling module 44. Once the vessel 28 has been lowered to a predetermined depth within the shaft 22, the hydraulic cylinders 76 are actuated and the anchor shoes 68 and 70 are extended through their respective openings 62 and 64 to contact the interior surface of the vertical shaft 22. Although the anchor shoes are substantially rectangular in shape, an outer surface of each anchor shoe is curved (FIG. 3) to match the typical curvature of the vertical shaft and allow for conformed contact between the shaft wall (or liner if the shaft is lined) and substantially the entire outer surface of the anchor shoes 68 and 70. The large contact area between the shaft wall or liner and the anchor shoes enhances the frictional contact therebetween so that the hydraulic cylinders 76 can develop sufficient force to allow the two pairs of anchor shoes 68 and 70 to maintain the position of the vessel 28 within the shaft throughout the duration of the drilling process. Upon completion of the drilling process, the hydraulic cylinders 76 retract the anchor shoes 68 and 70 so that the string 24 of drill pipe 26 can raise the vessel 28.

The hydraulic insert ram 36 for applying force to the drill bit 32 is fixed within the drilling module 44, preferably midway between the upper and lower anchor shoes 68 and 70, as shown in FIGS. 2 and 3. The insert ram 36 preferably comprises three concentric cylindrical sections 80, 82 and 84 which are telescopically slidable relative to one another (FIGS. 3–6).

Figure 6:
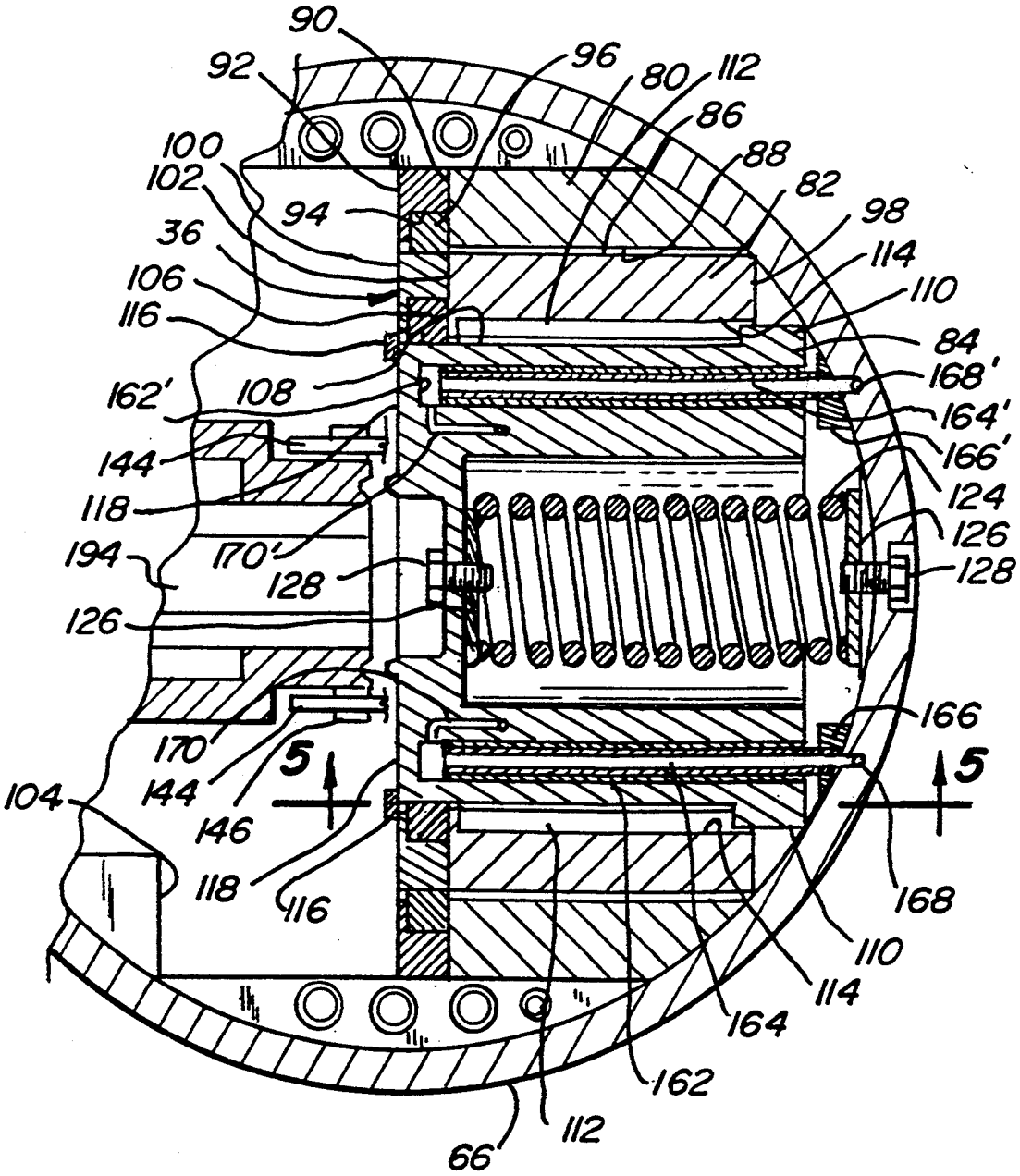
FIG. 6 is a section taken substantially in the plane of line 6—6 of FIG. 5.

The outer cylindrical section 80 of the insert ram 36 is mounted to the casing 66 of the drilling module 44 between the upper and lower anchor shoes 68 and 70 (FIG. 3). An outer surface 86 of the intermediate cylindrical section 82 has substantially the same diameter as an inner surface 88 of the outer section 80 so that the intermediate section 82 may slide axially relative to the fixed outer section 80. The free end of the outer section 80 defines an annular front face 90 to which is bolted an annular ring 92 (FIGS. 3–6). The annular ring 92 is shaped to form an annular groove 94 adjacent the front face 90 of the outer section 80 to receive an o-ring seal 96 therein (FIGS. 5 and 6). The o-ring seal 96 maintains contact with the outer surface 86 of the intermediate section 82 to provide a hydraulic seal between the outer and intermediate sections during movement of the intermediate section. The intermediate section 82 moves between a fully retracted position (FIGS. 4–6) in which a rear end 98 of the intermediate section contacts the casing 66 of the drilling module 44, and a fully extended position wherein an annular ring 100 attached to an annular front face 102 of the intermediate section 82 contacts a stop member 104 (FIG. 4) fixed to the casing of the drilling module. In the fully extended position, the rear end 98 of the intermediate section 82 remains in contact with the o-ring seal 96 to maintain the integrity of the hydraulic seal throughout the full range of motion of the intermediate section.

The annular ring 100 on the intermediate section 82 also houses an o-ring seal 106 for contacting an outer surface 108 of the inner section 84 of the insert ram 36 as the inner section moves relative to the intermediate section. The outer surface 108 of the inner section 84 includes a plurality of raised tabs 110 at its rear end (FIG. 6). These tabs 110 are aligned to slide within matching grooves 112 formed along an inner surface 114 of the intermediate section 82, as shown in FIG. 6. The fully extended position of the inner section 84 (FIG. 3) is defined by contact between the tabs 110 and a front end of the grooves 112 adjacent the front face 102 of the intermediate section. The fully retracted position of the inner section 84 (relative to the intermediate section 82) is attained when a flange 116 attached to a front annular face 118 of the inner section 84 contacts the annular ring 100 of the intermediate section 82, as shown in FIGS. 4–6.

The three concentric sections 80, 82 and 84 and the two o-ring seals 96 and 106 allow the intermediate and inner sections to act like pistons within a hydraulic cylinder formed by the outer section 80, and further allow the inner section 84 to act like a piston within a cylinder formed by the intermediate section 82.

Figure 4:
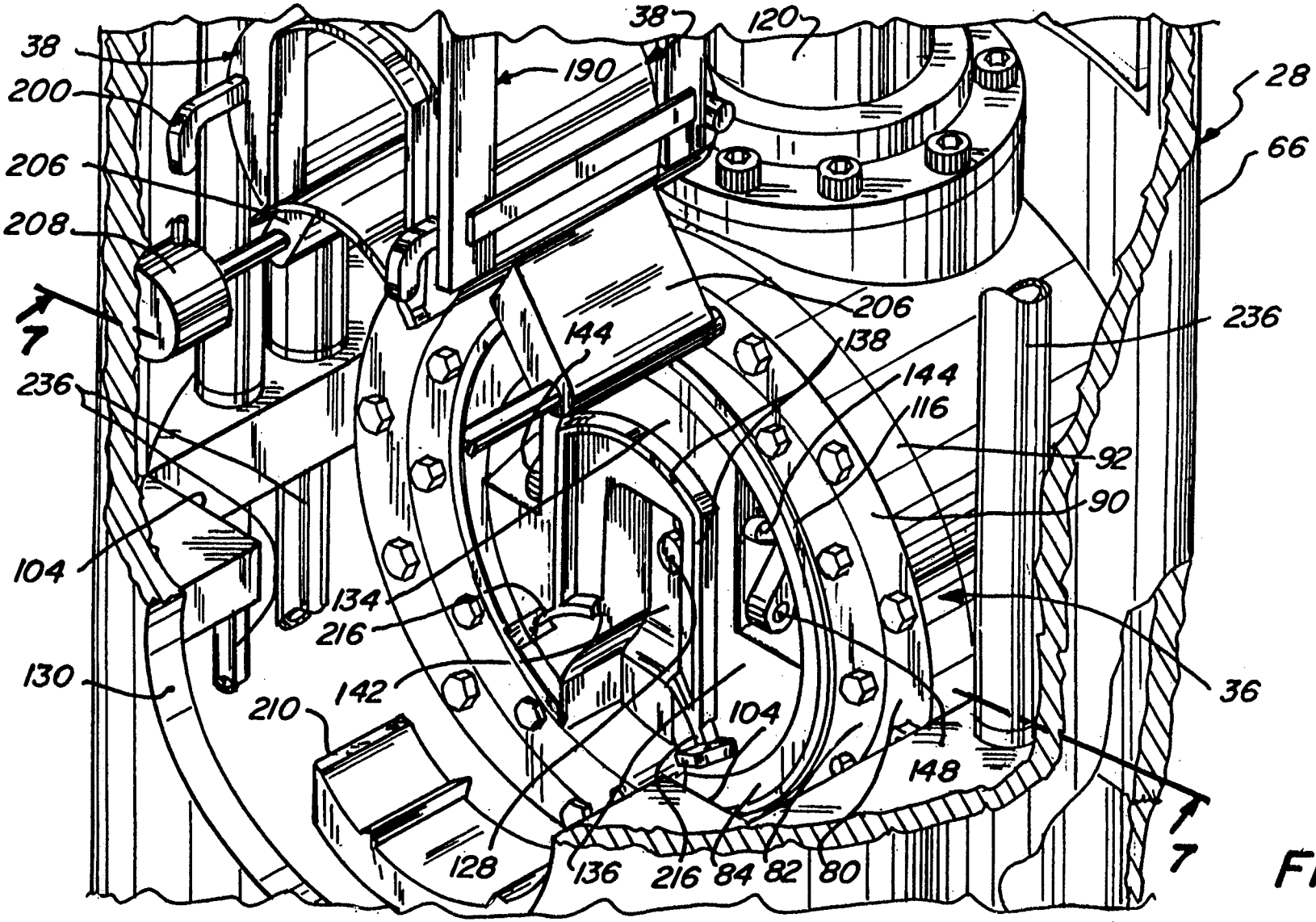
FIG. 4 is an enlarged fragmented isometric view similar to FIG. 3, with the drill head deleted to show details of an insert ram.

A high pressure hydraulic line 120 extends from the control module 42, through the horizontal bulkhead 40 and into the drilling module 44 where it mates with an opening 122 in the outer section, as shown in FIGS. 2–4. The hydraulic oil within the high pressure line 120 is thus fed into the interior volume defined by the three concentric sections, where it actuates both the intermediate and the inner sections. Due to the larger surface area associated with the inner section 84, the inner section tends to respond more quickly to the hydraulic pressure. Thus, the inner section will usually be fully extended relative to the intermediate section 82 before the intermediate section is fully extended relative to the outer section 80. However, upon full extension of the inner section 84, the tabs 110 will contact the front ends of the grooves 112 in the intermediate section 82 and will thus tend to pull the intermediate section toward full extension relative to the outer section 80.

By reversing the flow of hydraulic oil within the high pressure line 120, the intermediate and inner sections are pulled back toward their retracted positions. Again, since the inner section 84 is more responsive to the hydraulic pressure than the intermediate section 82, the flange 116 on the front face 118 of the inner section will contact the intermediate section and tend to pull the intermediate section toward its retracted position once the inner section is fully retracted relative to the intermediate section.

To enhance the retraction step, the insert ram 36 is preferably biased toward its retracted position by a spring 124, as shown in FIG. 6. The opposite ends of the spring are fixed to spring plates 126 which, in turn, are attached by bolts 128 to one end of the inner section 84 and to the casing 66 of the drilling module 44, respectively. During the extension of the insert ram 36, the intermediate section 82 tends to remain in contact with the flange 116 on the spring biased inner section 84 until such time as the intermediate section reaches the stop member 104. Further movement of the insert ram 36 at that point results only from movement of the inner section 84 relative to the intermediate section 82 and against the force of the spring 124. During the retraction step, the spring-biased inner section 84 tends to retract much more quickly than the intermediate section 82, once again causing the flange 116 on the inner section to remain in contact with the intermediate section and pull it toward its retracted position.

Figure 15:
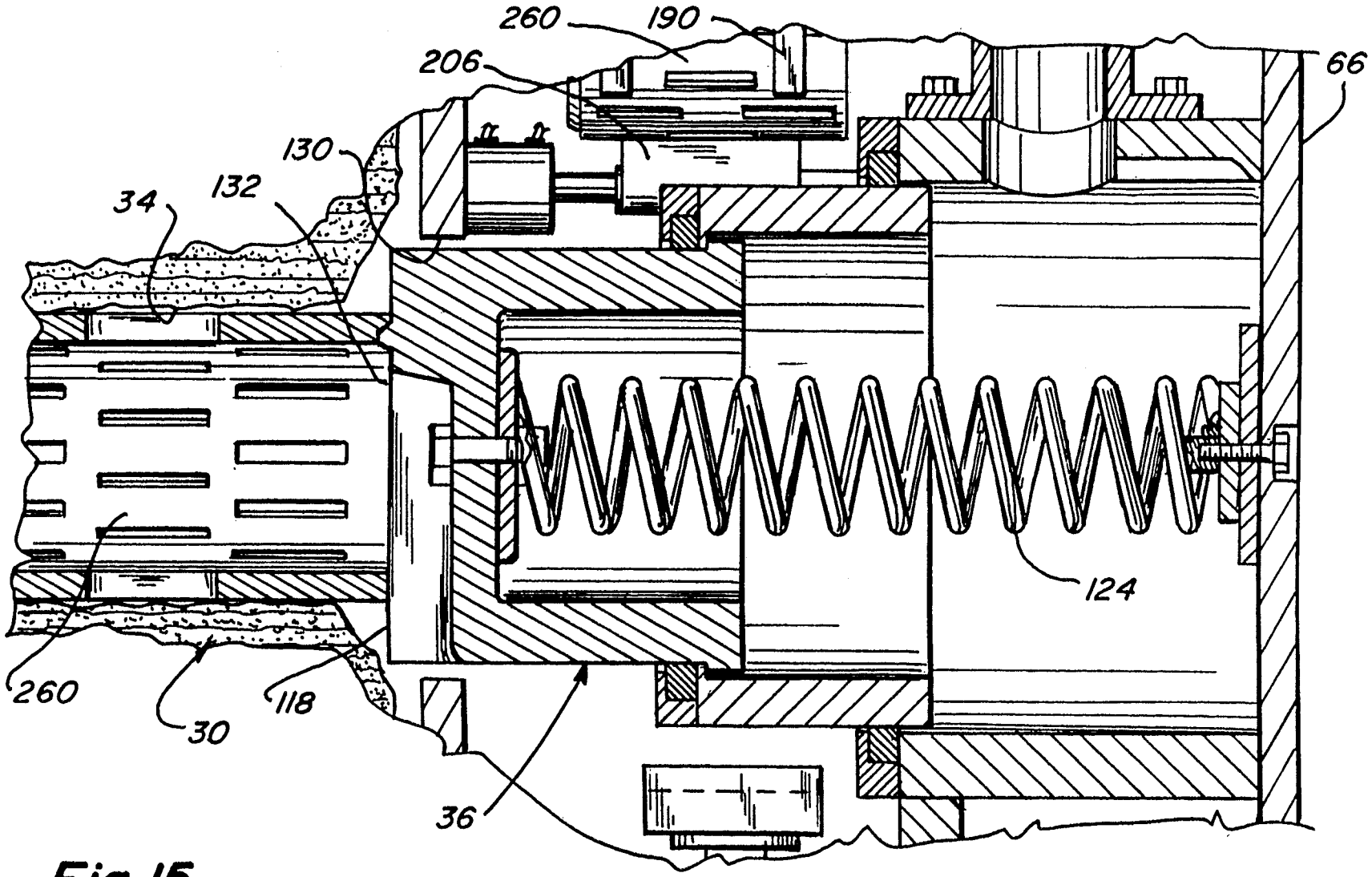
FIG. 15 is an enlarged section taken substantially in the plane of line 15—15 of FIG. 14.

As shown in FIG. 15, when both the intermediate and the inner sections are fully extended, the front annular face 118 of the inner section 84 extends through a preferably round opening 130 formed in the outer casing 66 of the drilling module 44 midway between one set of the upper and lower openings 62 and 64 (FIG. 1). The diameter of the round opening 130 is larger than the diameter of the outer surface 108 of the inner section 84, and is sufficiently large to allow the drill bit 32 to pass therethrough.

Figure 10:
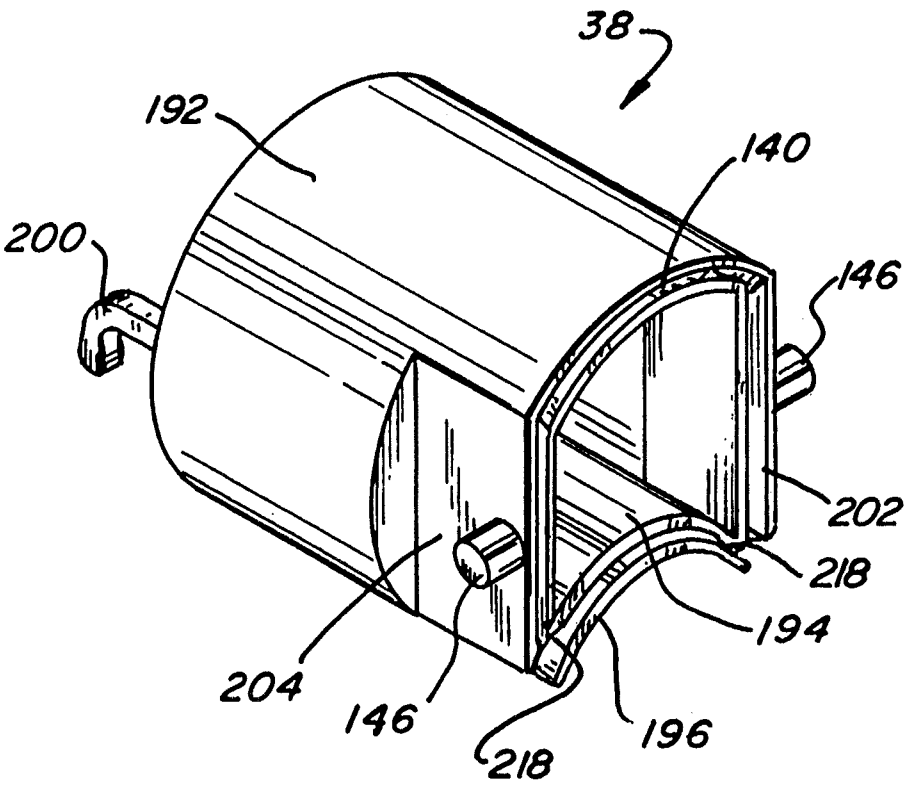
FIG. 10 is an isometric view of the shim.

The inner section 84 of the insert ram 36 includes a central ram portion 132 (FIG. 4) which is adapted to mate with both the drill bit 32 and the shims 38. The central ram portion is formed within the perimeter of the annular front face 118 of the inner section 84 and preferably includes a substantially rectangular top section 134 and a semi-circular bottom section 136. A protruding mating surface 138 is preferably formed integrally with the central ram portion 132, as shown in FIG. 4, and is adapted to be received within a matching groove 140 on a rear end of both the drill bit 32 and the shims 38 (FIG. 10). A notch 142 is formed within both the central ram portion 132 and a bottom segment of the annular front face 118 of the inner section 84 (FIG. 4) for a purpose that will be explained below.

The central ram portion 132 also includes a pair of pivotable pawls 144 (FIGS. 3–6) which are adapted to engage pins 146 on the rear end of both the drill bit 32 and the shims 38, as shown in FIGS. 3, 5 and 6. The pawls 144 help to maintain contact between the insert ram 36 and the drill bit 32 and shims 38, and may be used to retract the shims and drill bit from the lateral borehole 34, as described below. The pawls 144 are pivotably attached by a pivot pin 148 on opposite sides of the rectangular top section 134 of the central ram portion 132, as shown in FIGS. 4–6, and may be pivoted between an "up" or "open" position (FIG. 4) and a "down" or "closed" position (FIGS. 3, 5 and 6).

An independent hydraulic system for operating the pawls 144 is shown in FIGS. 5 and 6. A hydraulic cylinder 150 is pivotably attached at a rear end 152 thereof to the side of the rectangular top section 134 behind each of the two pawls 144. A piston (not shown) within the cylinder 150 actuates a piston rod 154 which is pivotably attached to a flange 156 on the pawl 144, as best shown in FIG. 5. When the piston rod 154 is fully extended, the pawl 144 is in the down position (FIG. 5). As the piston rod 154 is retracted within the cylinder 150, the pawl 144 rotates about the pivot pin 148 which causes the flange 156 and the end of the piston rod 154 to rise upward in an arc toward the cylinder 150. The arcing movement of the flange 156 and the piston rod 154 necessarily causes the cylinder 150 to pivot upwards about the pivot point at its rear end 152.

Two hydraulic lines 158 and 160 for actuating the piston are attached to opposite ends of each cylinder 150, as shown in FIG. 5. Due to the nature of the inner section 84 being slidable into and out of a recessed position within the intermediate section 82, it is desirable that the hydraulic fluid for the lines 158 and 160 not be supplied by lines that are external to the insert ram 36. Thus, a method such as that shown in FIGS. 5 and 6 is preferably used to supply hydraulic fluid to the cylinders 150. The method includes forming a horizontal conduit 162 within the semi-circular bottom section 136, as shown in FIGS. 5 and 6. A horizontal pipe 164 extends into the conduit 162 from a fixture 166 in the casing 66 of the drilling module 44. Hydraulic fluid is supplied from the control module 42 to the fixture 166 along a vertical passageway 168 formed in the casing 66 of the drilling module 44 (FIG. 5). As shown in FIG. 6, a free end of the pipe 164 terminates at a point rearwardly of a closed end of the conduit 162 when the insert ram 36 is in its fully retracted position. However, the pipe 164 is sufficiently long to allow the free end of the pipe to remain within the conduit 162 when the insert ram is moved to its fully extended position. Additionally, an o-ring (not shown) at the open end of the conduit 162 maintains a hydraulic seal within the conduit as the inner section 84 of the insert ram slides over the pipe 164. Thus, pressurized hydraulic fluid can be maintained within the sealed conduit 162 throughout the entire range of movement of the insert ram 36.

An additional passage 170 formed within the inner section 84 of the insert ram 36 includes two branches which conduct the hydraulic fluid (in parallel) from a port at the closed end of the conduit 162 to the forward hydraulic lines 158 on both of the cylinders 150. The rear hydraulic lines 160 on both the cylinders 150 are in parallel fluid communication with two branches of the passage 170' leading from the conduit 162' on the other side of the central ram portion 132 of the inner section 84. In this manner, the passageway 168, pipe 164, conduit 162 and passage 170 can simultaneously actuate both cylinders 150 to move both pistons (and thus both pawls 144) in one direction, while the opposite passageway 168' pipe 164' conduit 162' and passage 170' can simultaneously move the pistons of both cylinders 150 in the opposite direction. Thus, the pawls 144 can be opened or closed about the pins 146 of the drill bit 32 or shims 38 at any point along the movement of the insert ram 36, as dictated by the control module 42.

Rotary drill bits are well known in the industry, and the rotary bit 32 is of a typical design, having a rotatable cutting head 172 and a non-rotating rear segment 174. However, the rear segment 174 of the drill bit 32 has been modified to include the pins 146 and the groove 140, and to substantially conform to the shape of a rear portion of the shims 38 (FIG. 10), as described below. The rotary bit is hydraulically powered and drilling mud is typically applied to the drill bit 32 to both cool and lubricate the bit as well as excavate the debris that is cut by the drill bit. The hydraulic fluid and the drilling mud are supplied to the rotary bit through separate lines contained within a single hose 176 as shown in FIGS. 3 and 5. A predetermined length of the hose 176 may be wrapped around a spool 178 within the drilling module 44, as shown in FIGS. 2, 3 and 5. The separate lines containing the hydraulic fluid and drilling mud from the control module 42 are supplied to the spool 178 where they are combined within the hose 176. The spool 178 preferably rotates freely as the insert ram 36 is extended and the hose 176 is pulled from the spool. However, when the drill bit 32 is retracted as described below, a hydraulic motor 180 is preferably used to rotate the spool 178 in an opposite direction and thereby collect the hose 176 that was played out.

A hose guide 182 preferably comprising a U-shaped curved channel may be used as shown in FIGS. 2, 3 and 5 to direct the hose 176 as it plays out from the spool 178 and prevent the hose from becoming snagged on the bottom of the round opening 130 as the drill bit 32 bores into the earth. A flange 184 of the hose guide 182 is fixed to the free end of a piston rod 186 of a hydraulic cylinder 188. Hydraulic fluid supplied from the control module 42 actuates a piston (not shown) within the cylinder 188 to move the hose guide 182 vertically for a purpose described more fully below.

Figure 11:
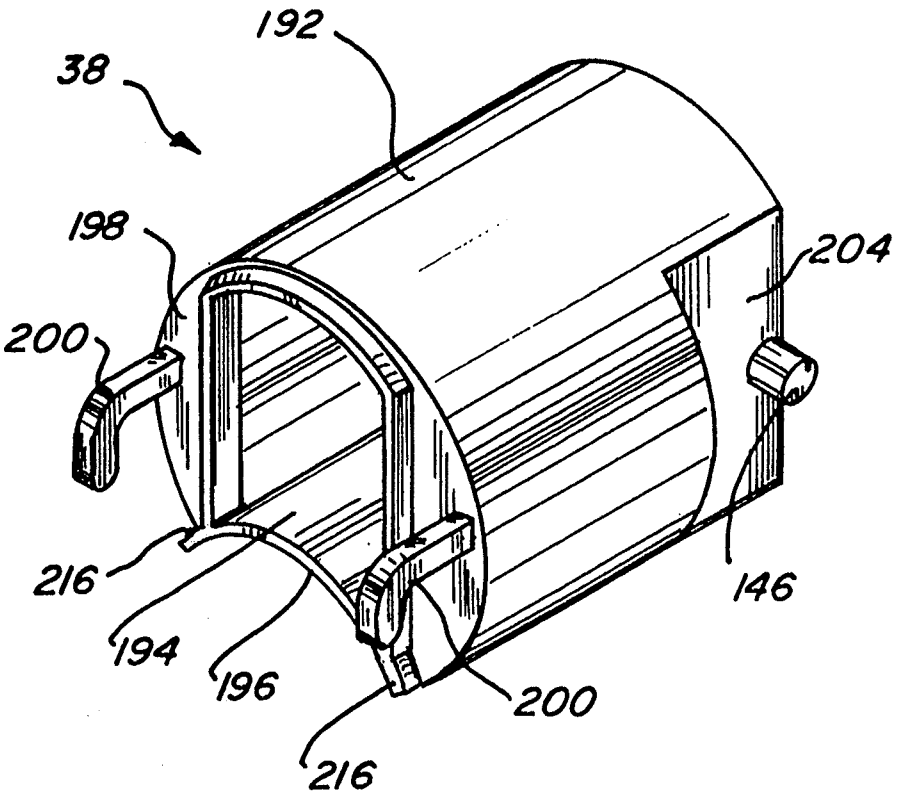
FIG. 11 is an isometric view of an opposite side of the shim shown in FIG. 10.

The drilling module 44 also contains a plurality of shims 38 stored vertically within a magazine 190, as shown in FIGS. 2 and 3. The shims 38 are shown in detail in FIGS. 10 and 11 and preferably comprise a substantially cylindrical outer body 192 having an interior volume 194 with a substantially rectangular cross section. The top and bottom portions of the substantially rectangular cross section are curved upwards to define a channel 196 underneath the shim 38. A front face 198 of the shim 38 includes the same protruding mating surface 138 as found on the central ram portion 132 of the inner section 84. The front face 198 also includes two laterally opposing pawls 200 fixed in a "closed" position as shown in FIG. 11. A rear face 202 of the shim 38 includes the matching groove 140 as described above. A rear segment of the shim 38 includes flat external sides 204 upon which the above-described pins 146 are fixed. In this manner, the pins 146 are effectively recessed within the rear segment of the shims 38 so as to not protrude beyond the annular circumference defined by the cylindrical outer body 192 of the shim 38.

Figure 9:
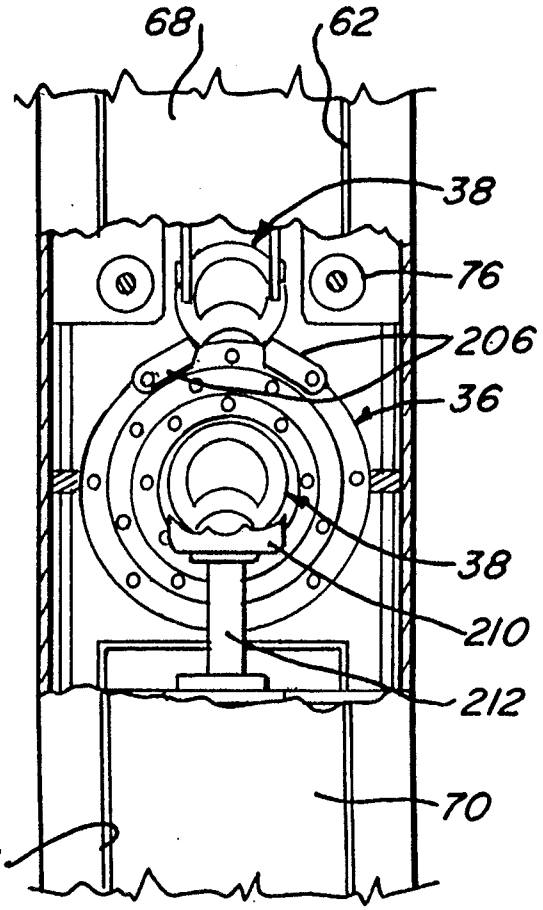
FIG. 9 is a plan view similar to FIGS. 7 and 8, showing the loading ram in an intermediate position to align the shim with the insert ram.
Figure 8:
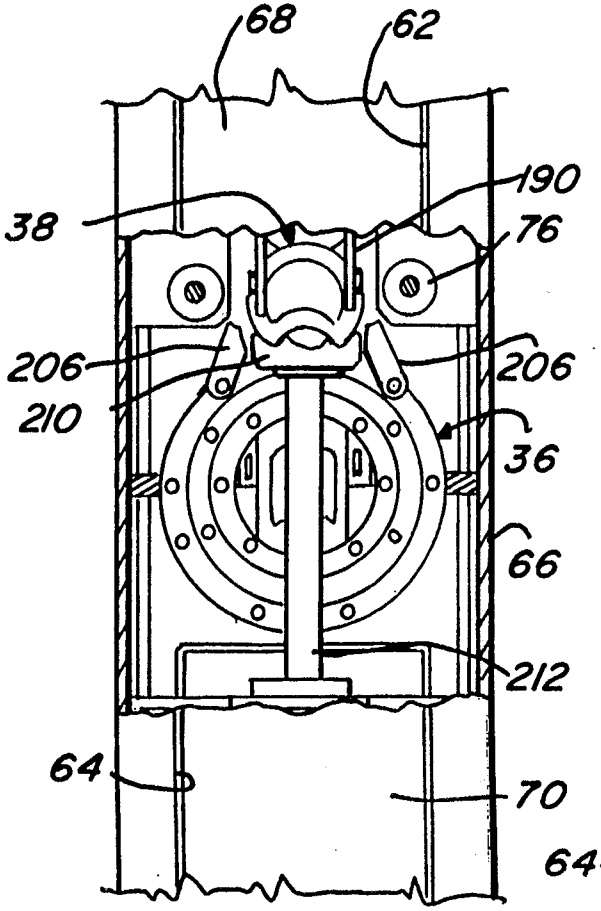
FIG. 8 is a plan view similar to FIG. 7, showing the loading ram in an up position to load a shim.
Figure 7:
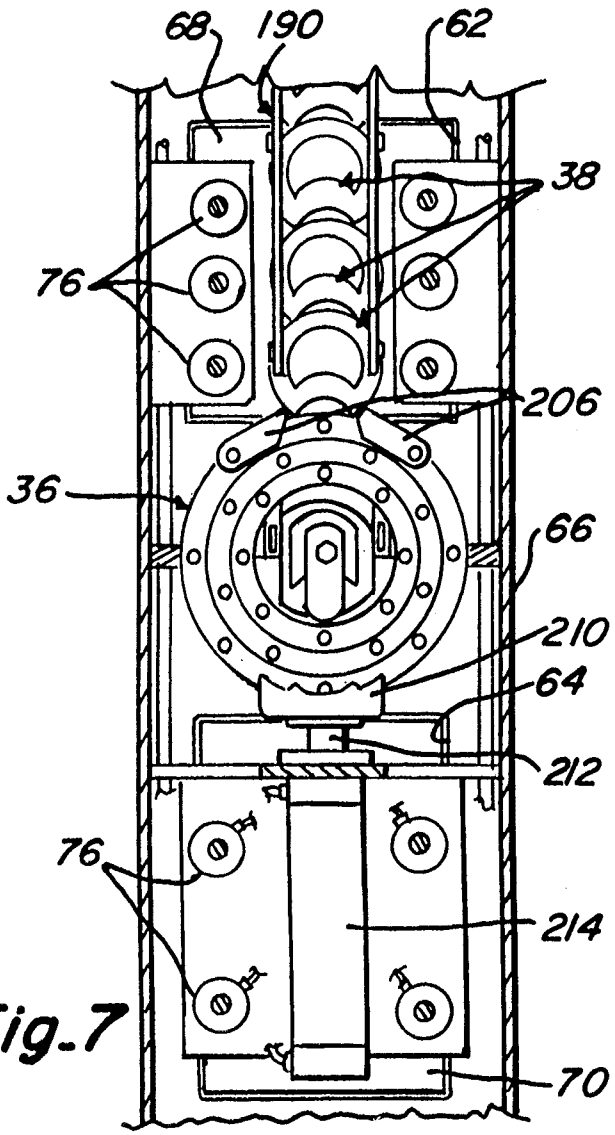
FIG. 7 is a section taken substantially in the plane of line 7—7 of FIG. 4, showing a loading ram in a down or unloaded position.

The magazine 190 for storing and dispensing the shims 38 is of a known design and is preferably fixed within the drilling module 44 in a position above and forward of the insert ram 36 when the ram is in its fully retracted position. A pair of feed lugs 206 (FIGS. 3, 5 and 7–9) are pivotably attached between the casing 66 of the drilling module 44 and the stationary outer section 80 of the insert ram. The feed lugs 206 are spring biased to a "closed" position, as shown in FIGS. 3, 7 and 9, to maintain the stack of shims 38 within the magazine 190. However, a conventional hydraulic motor 208 generates sufficient torque to overcome the spring bias and pivot the feed lugs 206 to an "open" position as shown in FIG. 8.

A loading ram 210 comprising a substantially U-shaped bed is attached to a piston rod 212 of a hydraulic cylinder 214 directly below the magazine 190. The hydraulic cylinder 214 is capable of moving the loading ram 210 between three separate positions: an "up" or "load" position for receiving a shim 38 from the magazine 190 (FIG. 8), an intermediate position for aligning the shim 38 with the insert ram 36 (FIGS. 5 and 9), and a "down" or "unloaded" position below the level of the extended insert ram (FIGS. 3 and 7). In the "load" position, the loading ram 210 is positioned directly underneath the bottom shim 38 in the magazine 190 while the feed lugs 206 are still in the closed position. The hydraulic motor 208 then opens the feed lugs 206 (FIG. 8) so that the loading ram 210 may receive the bottom shim 38. As the loading ram 210 descends to the intermediate position (FIG. 9), the hydraulic motor 208 relaxes the torsional force on the feed lugs 206 so that the spring biased lugs may return to their closed position and engage the next shim 38 in the magazine 190.

The process of drilling a lateral borehole 34 begins with lowering the vessel 28 into the vertical shaft 22 by the string 24 of drill pipes 26 (FIG. 1). The umbilical cord 50 attached to the control module 42 is allowed to play out from the up-hole control station 48. As the vessel 28 descends, the anchor shoes 68 and 70 are retracted within the vessel and the loading ram 210 is fixed in the intermediate position where it holds the rotary drill bit 32 (FIG. 2). The pawls 144 are also closed about the pins 146 on the rear of the drill bit 32 to maintain the protruding mating surface 138 of the insert ram 36 within the matching groove 140 on the rear of the drill bit 32 during the vessel's descent. To accommodate this initial position of the insert ram 36, the hydraulic cylinder 188 positions the hose guide 182 at an intermediate height as shown in FIG. 2 to allow the hose 176 sufficient room to double back to its point of attachment with the drill bit 32 at a position behind the hose guide 182.

Once the vessel 28 has been lowered to the desired depth and the anchor shoes extended to hold the vessel within the shaft 22, the insert ram 36 extends the rotary drill bit 32 through the round opening 130 so that the bit contacts the earthen wall of the vertical shaft. The loading ram 210 is then lowered to its down position to clear the path of the insert ram 36 as the rotary drill bit 32 is activated. Upon activation of the bit, the control system 46 directs drilling mud from the control module 42 through the hose 176 to the drill bit 32 to both cool and lubricate the cutting head 172 and excavate the debris formed by the bit. While a small portion of the drilling mud drains from the lateral borehole 34 around an outer perimeter of the drill bit 32, the majority of the drilling mud and its captured debris is forced through the hollow center of the drill bit toward the insert ram 36. The above-described notch 142 in the central ram portion 132 of the inner section 84 channels the drilling mud down past the open bottom of the drilling module 44 (FIG. 2) where the mud is pumped to the surface in a known manner and recycled to be used again within the vessel 28.

As the insert ram 36 pushes the drill bit 32 forward, the protruding mating surface 138 on the ram remains engaged with the matching groove 140 within the rear of the drill bit. The protruding mating surface 138 preferably includes two locking tabs 216, best shown in FIG. 4, which are received within matching slots 218 formed on the rear of both the drill bit 32 and the shims 38. The engagement of the locking tabs 216 in the slots 218 opposes the torque generated by the rotating cutting head 172 and prevents the rear segment 174 of the drill bit 32 from rotating during operation of the bit. Furthermore, as the end of the hose 176 attached to the drill bit passes through the round opening 130, additional hydraulic fluid is supplied to the cylinder 188 to raise the hose guide 182 to its fully extended position and thereby situate the hose 176 within the channel 196 formed underneath the rear segment 174 of the drill bit 32, as shown in FIG. 5. In the fully extended position, the hose guide 182 is better able to prevent the hose 176 from becoming snagged on the bottom of the round opening 130.

Once the insert ram 36 is extended a predetermined distance equal to the length of one of the shims 38 (FIG. 5), the rotary drill bit 32 ceases operations to allow the insert ram to detach itself from the drill bit and move to its fully retracted position. This is accomplished by opening the pawls 144 which were previously closed about the pins 146 on the drill bit 32, and then retracting both the inner and intermediate sections 84 and 82, respectively, of the insert ram 36 as described above. The drill bit 32 remains in place following the separation of the insert ram 36 due to the fact that the cutting head 172 is wedged into place within the lateral borehole 34 and due to the support supplied by the hose 176 and the hose guide 182, as shown in FIG. 5. The cessation of the drill bit 32 is necessary to prevent the torque generated by the cutting head 172 from spinning the entire drill bit 32 after the protruding mating surface 138 and the locking tabs 216 of the insert ram 36 withdraw from the matching groove 140 and slots 218 on the rear of the drill bit 32.

Once the insert ram 36 is fully retracted, the hydraulic cylinder 214 moves the loading ram 210 through the sequence shown in FIGS. 7–9. Thus, the loading ram 210 is moved from its down position (FIG. 7) to its up or "load" position (FIG. 8) to receive a shim 38 from the magazine 190. As the loading ram 210 contacts the bottom shim 38 in the magazine, the feed lugs 206 open in the above-described manner to allow the loading ram to momentarily bear the weight of the entire shim stack. However, as the loading ram 210 moves toward the intermediate position, the feed lugs 206 quickly close to prevent the next shim 38 in the stack from escaping the magazine 190.

The shims 38 are loaded within the magazine 190 so that their fixed pawls 200 face forward, as shown in FIGS. 3 and 4. Thus, as the loading ram 210 lowers the shim 38 to the level of the insert ram 36, the fixed pawls 200 engage the pins 146 at the rear of the drill bit 32, as shown in FIG. 5. The loading ram 210 continues to support the shim 38 as the pawls 144 are closed about the pins 146 on the rear face 202 of the shim, and the insert ram 36 is extended forward so that the protruding mating surface 138 of the insert ram is inserted within the matching groove 140 on the rear face 202 of the shim. Continued extension of the insert ram 36 moves the shim 38 forward over the loading ram 210 so that the protruding mating surface 138 on the front face 198 of the shim 38 is inserted within the matching groove 140 at the rear of the drill bit. Once the shim 38 is fixed between the insert ram 36 and the drill bit 32, the loading ram 210 is lowered to its down position to clear the path of the insert ram 36. The drill bit 32 may then resume operations as the locking tabs 216 on the insert ram are fixed within the slots 218 on the rear face 202 of the shim 38, and the locking tabs 216 on the front face 198 of the shim 38 are fixed within the slots 218 on the rear of the drill bit 32 to assure the torsional stability of the bit and shim combination.

As the insert ram 36 extends the shim 38 and the joined drill bit 32 forward, the hose 176 plays out from the spool 178 and is directed by the hose guide 182 into the channel 196 beneath the drill bit and the shim. The majority of the used drilling mud and debris generated by the drill bit 32 passes through the hollow interiors of both the drill bit 32 and the shim 38 to again be directed by the notch 142 toward the bottom of the vertical shaft 22. The insert ram 36 continues to extend the shim 38 forward for the predetermined distance, at which point the drill bit 32 is stopped again and the above process is repeated with an additional shim 38 from the magazine 190.

Additional shims 38 may be added to the line (FIG. 3) until the lateral borehole 34 reaches a predetermined length or until the magazine 190 is emptied. Although not shown in the figures, the single fixed magazine 190 could be replaced by a plurality of magazines arranged on a carousel which would rotate a full magazine into position above the loading ram 210 once the previous magazine was depleted of shims 38. In this manner, the number and functional variety of shims inserted into the lateral borehole 34 may be varied to increase the length of the borehole and the type of functions it may perform.

The shims 38 are preferably made from welded and machined steel, and thus may represent a substantial investment. Additionally, although the cutting head 172 may be dulled after drilling the lateral borehole 34, the rotary drill bit 32 also constitutes a substantial investment. Therefore, upon completion of the lateral borehole 34, it is desirable to be able to withdraw the shims 38 and the drill bit 32 from the borehole 34 and store them in their initial positions within the drilling module 44 of the vessel 28.

To retrieve the shims and drill bit 32, the insert ram 36, loading ram 210, feed lugs 206 and hose spool 178 operate in a manner which is essentially opposite to that described above. First, the insert ram 36 is extended the predetermined distance so that the central ram portion 132 contacts the trailing shim 38, and the pawls 144 are closed upon the pins 146 of the shim 38. As the insert ram 36 retracts the trailing shim, it sets up a chain reaction along the line of shims within the borehole 34 as the fixed pawls 200 on each shim 38 engage the pins 146 on the shim ahead of it until the pawls 200 on the first shim contact the pins 146 on the drill bit 32.

Once the "slack" between all the shims 38 has been taken up, the continued retraction of the insert ram 36 tends to pull the line of shims and the drill bit 32 from the borehole 34. As the insert ram 36 moves to its fully retracted position (as shown in FIG. 5), the loading ram 210 is raised to support the trailing shim 38 which is effectively suspended between the pawls 144 on the insert ram and the pins 146 on the adjacent shim. After the insert ram 36 is fully retracted and the trailing shim 38 is properly situated on the loading ram 210, the pawls 144 on the insert ram 36 open to allow the loading ram to raise the shim toward the magazine 190. As the shim 38 contacts the bottom of the feed lugs 206, the lugs open in a manner similar to that shown in FIG. 8 to allow the shim access to the magazine 190. As the loading ram 210 reaches its maximum height, the feed lugs 206 close to maintain the shim 38 within the magazine 190, thereby allowing the loading ram to return to its down position (FIG. 7). Next, the insert ram 36 extends the predetermined distance again to grasp the next shim 38 in line, and the process repeats itself until all the shims are loaded within the magazine 190.

As the drill bit 32 and shims 38 are pulled toward the round opening 130 in the drilling module 44, the hose 176 within the channel 196 underneath the shims 38 and the drill bit 32 is also pulled back and coiled on the spool 178. This is accomplished by using the hydraulic motor 180 to run the spool in reverse and thereby retract the hose 176. Once the last shim 38 is returned to the magazine 190, the insert ram 36 is extended again to grasp the pins 146 on the drill bit 32. The hose guide 182 again acts to support the drill bit 32 as it is pulled through the round opening 130 and into the casing 66 of the drilling module 44. Once the insert ram 36 is retracted a sufficient distance, the loading ram 210 is raised to contact and support the drill bit 32, while the hose guide 182 is lowered to prevent damaging the hose 176 or severing the connection between the hose and the drill bit. Full retraction of the insert ram 36 assures that the drill bit 32 is positioned completely within the casing 66 of the drilling module 44, as shown in FIG. 2.

Once stored in this manner, the anchor shoes 68 and 70 are released and the vessel 28 may be returned to the surface with the shims 38 and drill bit 32 for use in a different oil well. Alternatively, prior to returning the vessel 28 to the surface, the drill string 24 may be rotated to thereby rotate the vessel while it is still at the depth of the pay zone 30. Following rotation of the vessel 28 within the vertical shaft 22, the entire process may be repeated to form a new lateral borehole along a different radial line from the first borehole 34.

In case of a malfunction which prevents the drill bit 32 from being retracted within the vessel 28 as described above (e.g., the pins 146 breaking off the drill bit 32 or one of the shims 38), the drill bit and the remaining shims may be abandoned within the lateral borehole 34.

First, the insert ram 36 is fully extended to push the adjacent drill bit 32 or shim 38 beyond the round opening 130 so that the drill bit or shim cannot interfere with the drilling module 44 as the vessel 28 is raised to the surface. Next, the hose 176 attached to the drill bit 32 must be severed to prevent the hose from interfering with the withdrawal of the vessel 28. Toward this end, the hose guide 182 preferably includes a retaining band 220 to keep the hose 176 secured within the U-shaped curved channel (FIGS. 3 and 5). Furthermore, a knife edge 222 is preferably fixed within the drilling module 44 at the top of the round opening 130, as shown in FIG. 5. Once the adjacent drill bit 32 or shim 38 has been pushed beyond the round opening 130, the cylinder 188 retracts the piston rod 186 to the maximum extent possible, thereby lowering the hose guide 182 past the knife edge 222 and severing the hose 176. The spool 178 may then retract the severed end of the hose 176 in preparation for withdrawal of the vessel 28.

Figure 12:
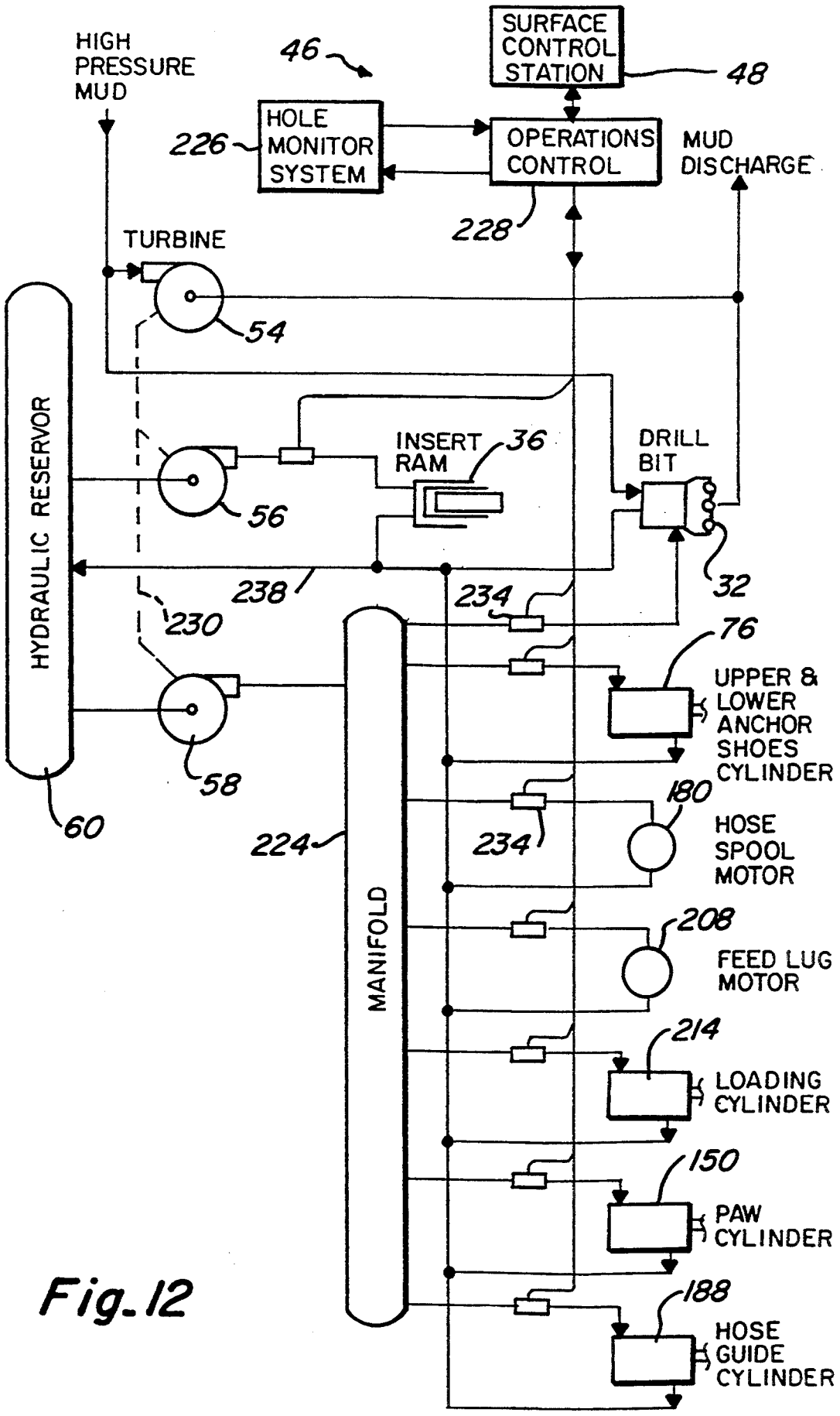
FIG. 12 is a schematic view of the present invention shown in FIG. 1.

FIG. 12 illustrates a schematic of the present invention as described above. The control module 42, best shown in FIG. 2, contains the turbine 54, the two pumps 56 and 58, the reservoir 60 of hydraulic fluid, a hydraulic fluid manifold 224, and the control system 46 which includes both a monitoring system 226 and an operations control 228. The drilling mud is pumped at high pressure from the surface and passes into the control module 42 through the sealed fitting 52 to turn the turbine 54 which, in turn, runs both the high pressure pump 56 and the medium pressure pump 58 via a mechanical shaft 230. Both pumps draw hydraulic fluid from the reservoir 60 for purposes described below.

The high pressure hydraulic line 120 from the high pressure pump 56 passes through the bulkhead 40 and connects to the insert ram 36 as described above. As shown in FIG. 12, the high pressure pump 56 serves only the insert ram 36 due to the high forces that the insert ram is required to apply to the drill bit 32. On the other hand, the medium pressure pump 58 directs its hydraulic fluid through a hydraulic line 232 to pressurize the manifold 224 which, in turn, directs the hydraulic fluid as required by the control system 46. Thus, as shown in FIG. 12, the manifold 224 powers all the hydraulic cylinders and motors previously described, including: the cutting head 172 of the rotary drill bit 32; the cylinders 76 for the upper and lower anchor shoes 68 and 70; the hydraulic motor 180 for the hose spool 178; the hydraulic motor 208 for the feed lugs 206; the cylinder 214 for the loading ram 210; the cylinders 150 for the pivotable pawls 144; and the cylinder 188 for the hose guide 182.

The control system 46 monitors the position of the different components noted above, and, in conjunction with the up-hole control station 48, operates a plurality of valves 234 (FIG. 12) to direct the hydraulic fluid along various hydraulic lines 236 from the manifold 224 to the above-noted components. The method of directing hydraulic fluid from a pressurized manifold 224 to a plurality of components is well known in the prior art and will not be explained in detail here. The various hydraulic lines 236 from the manifold 224 pass from the sealed control module 42 through the bulkhead 40 and into the open drilling module 44. A return line 238 passes back through the bulkhead 40 to return the hydraulic fluid from the separate components to the reservoir 60 to renew the supply for the pumps 56 and 58.

Figure 13:
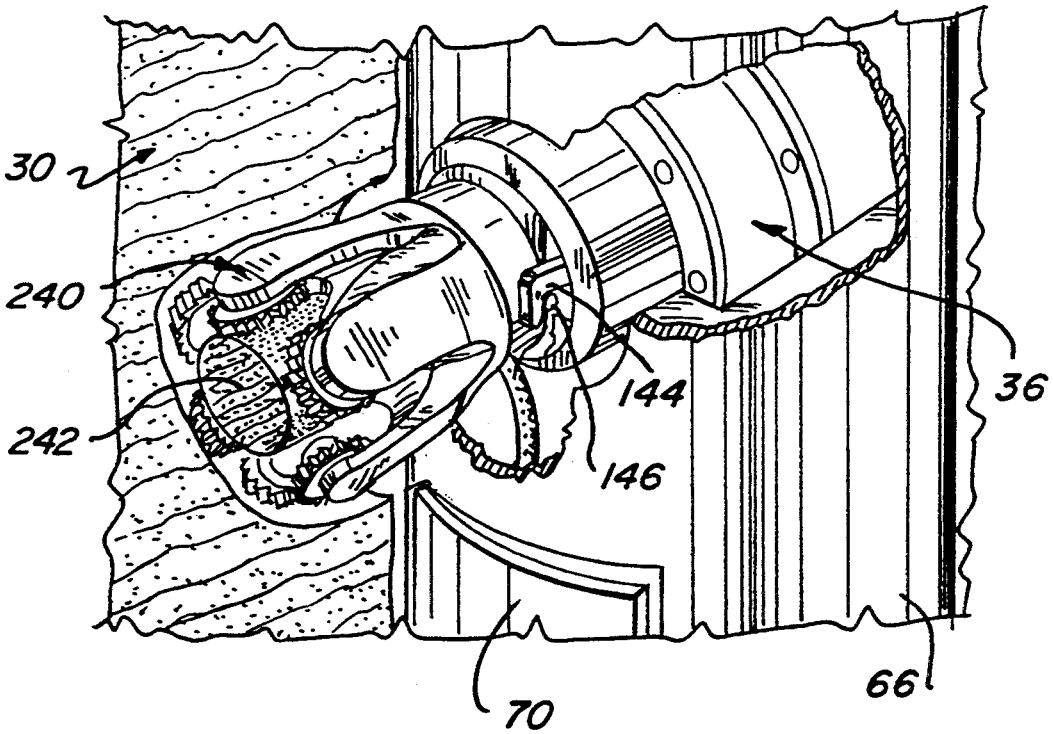
FIG. 13 is a fragmented isometric view illustrating a second application of the invention shown in FIGS. 1–12.

The vessel 28 may be used for other applications in addition to drilling the lateral borehole 34. FIG. 13 illustrates the drilling module 44 used with a typical coring bit 240 as opposed to the rotary drill bit 32. The coring bit 240 is typically used to retrieve samples of the formation at different levels within the vertical shaft 22 to determine the depth of the pay zone 30 for subsequent lateral drilling. The process of retrieving a core sample 242 is similar to the lateral drilling process described above with respect to the rotary drill bit 32.

The coring bit 240 is supported by the loading ram 210 in front of the insert ram 36 where the pawls 144 are closed about the pins 146 on the rear of the coring bit 240 as the vessel 28 is lowered to a desired depth. Once the anchor shoes 68 and 70 are set, the coring bit 240 is activated, the insert ram 36 is extended and the loading ram 210 is lowered as described above with respect to the rotary drill bit 32. Since the coring bit 240 must retain the core sample 242 that it cuts (as opposed to excavating a lateral borehole and washing away the debris as occurs with the rotary drill bit), no shims 38 are used to extend the reach of the coring bit 240 (FIG. 13). Instead, the insert ram 36 is fully extended to push the full length of the coring bit 240 through the round opening 130 in the casing 66, as opposed to the rotary bit 32 which is initially extended only a predetermined length equal to the length of a shim 38. After fully extending the coring bit 240 into the formation, the insert ram 36 is retracted and the grip of the pawls 144 about the pins 146 allows the coring bit 240 and its captive core sample 242 to be pulled completely within the drilling module 44 in a manner similar to that described above with respect to the rotary drill bit 32. Once the coring bit 240 and core sample 242 are securely supported within the drilling module 44, the vessel 28 is raised to the surface so that the core sample 242 may be analyzed.

Figure 14:
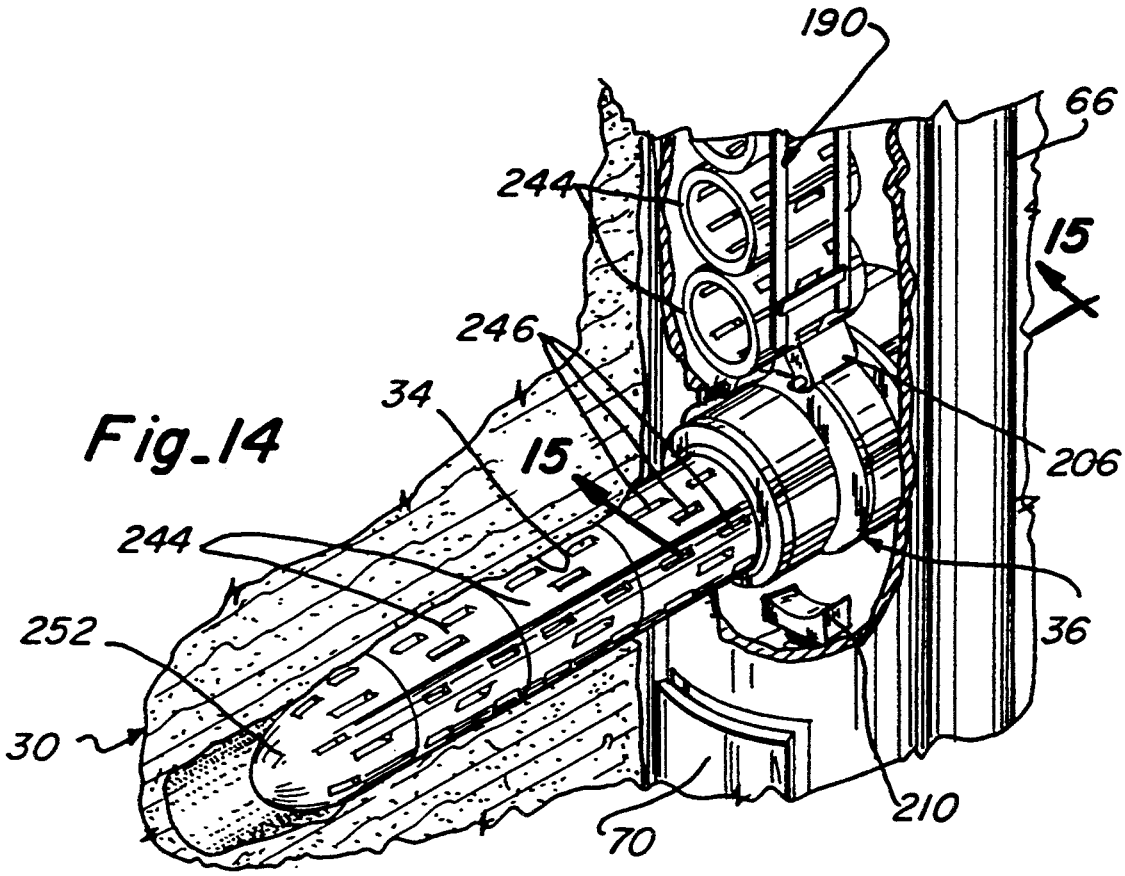
FIG. 14 is a fragmented isometric view illustrating a third application of the invention shown in FIGS. 1–12.

A further application of the vessel 28 includes inserting liner members 244 within a previously formed lateral borehole 34, as shown in FIGS. 14 and 15. The liner members 244 may be required in some types of rock or soil formations to prevent the lateral borehole 34 from caving in upon itself. The vessel 28 operates in substantially the same manner as described above with respect to the formation of the lateral borehole 34, except that no drill bit is used and the liner members 244 replace the shims 38 within the magazine 190.

The liner members 244 are preferably made from steel or plastic pipe and are cylindrical in shape, with no channel 196 formed underneath since there is no drill bit and thus no hose 176 which would necessitate a channel. Furthermore, since the liner members 244 are designed to be abandoned within the borehole 34, they do not include the pins 146 or fixed pawls 200 which allow the shims 38 and the rotary drill bit 32 to be retrieved and recycled. The liners 244 may include matching engagement surfaces on their front and rear faces (not shown in FIGS. 14 or 15, but similar to the protruding mating surface 138 and matching groove 140 used with the shims) to enhance the seal between adjacent liner members 244. Openings or drain holes 246 are preferably formed within the liner members 244 as shown in FIGS. 14 and 15. The openings 246 are sufficiently large to enhance the seepage of oil from the surrounding "pay zone" 30 into the lateral borehole 34, while not being so large as to allow rocks or other debris to pass therethrough and clog the lateral borehole.

The vessel in FIGS. 14 and 15 may be different (although substantially similar) from the vessel that formed the lateral borehole 34, or it may be the same vessel 28 with the shims 38 and drill bit 32 removed and refitted with a supply of the liner members 244. It is a simple matter to lower the vessel 28 to the approximate depth of the lateral borehole 34 (by counting the number of drill pipes 26 which comprised the original drill string 24), however, the round opening 130 in the casing 66 must be precisely aligned with the existing lateral borehole before the liner members 244 can be inserted into the borehole. Toward this end, a known magnetic pin setting and detecting device 248 is fixed within the vessel 28, preferably within the control module 42 as shown in FIG. 2.

After the first vessel 28 has formed the lateral borehole 34, and prior to releasing the anchor shoes 68 and 70, the device 248 shoots a magnetic pin 250 (FIG. 2) into the wall (or the liner) of the vertical shaft 22, as shown in FIG. 2. Subsequently, as the same vessel 28 (or a substantially similar one) is lowered to the approximate depth with a supply of the liner members 244 for lining the lateral borehole 34, the drill string 24 may be slowly lowered and rotated until the device 248 detects the magnetic pin 250, thereby allowing the operator to align the vessel 28 with the pin 250. Once properly aligned, the anchor shoes 68 and 70 are set and the loading and insert rams 210 and 36, respectively, operate in conjunction (as described above) to insert the liner members 244 into the borehole 34.

A leading liner member 252 inserted into the borehole 34 is preferably closed and rounded at its forward end (FIG. 14). Closing the forward end of the leading liner member 252 seals off the string of liner members 244, thereby preventing rock or debris at the forward end of the borehole 34 from filling the lined borehole 34. Furthermore, the rounded forward end is easier to push through loose rock or debris which may already be present within the borehole, thereby enhancing the insertion of the string of liner members.

As the insert ram 36 pushes the liner members 244 into the borehole 34, it is necessarily extended only the predetermined distance equal to the length of the liner members. However, as the last liner member 244 is pushed into the borehole 34, the insert ram 36 is fully extended, as shown in FIG. 15, to ensure that the rear end of the trailing liner member 244 is pushed beyond the round opening 130 and thus is clear of the drilling module 44 prior to releasing the anchor shoes 68 and 70 and raising the vessel 28.

The above applications of the vessel 28 (as shown in FIGS. 1–15) are ideal for drilling in rock or consolidated soils in which the lateral borehole 34 will not collapse upon itself between the time of drilling and prior to lining the borehole as described above. However, an alternative embodiment of the invention (FIGS. 16–19) may be utilized for drilling laterally through unconsolidated soils.

The vessel 254 shown in FIG. 16 is substantially similar to the vessel 28 shown in FIGS. 1–15, and identical reference numerals are used to describe identical components. The vessel 254 is used in conjunction with a penetrating head 256 (FIG. 17) as opposed to a rotary drill bit 32. The penetrating head 256 includes a leading cutting edge 258 to displace the unconsolidated soil as the insert ram 36 pushes the penetrating head 256, while high pressure drilling mud is used to excavate the displaced soil.

Due to the unconsolidated nature of the soil, the lateral borehole 34 would probably not withstand the withdrawal of the penetrating head 256 and the associated shims to allow the borehole to be lined by the method described above. Thus, each liner member 260 (FIG. 19) is formed in the shape of a shim 262 (FIGS. 16 and 18) and placed around the shims for simultaneous insertion into the lateral borehole 34, as shown in FIG. 16.

An annular flange 264 protruding within the penetrating head 256 to the rear of the cutting edge 258 defines a rear portion of the penetrating head to the rear of the flange. The rear portion of the penetrating head 256 is substantially identical to the liner member 260 shown in FIG. 19, including the openings 246 and the upwardly curved bottom portion which forms the channel 196 for a hose 266 supplying the high pressure drilling mud. The hose 266 is attached to a raised fluid connector 268 which extends into the hollow interior of the penetrating head 256 behind the flange 264 as shown in FIG. 17. The fluid connector 268 preferably has a flat top surface and a rounded trailing end.

The shims 262 are identical to the shims 38 described above, except for the addition of a ratchet member 270 positioned on the top of the shim adjacent its trailing end, as shown in FIG. 18. The ratchet member 270 has a cam surface facing the rear of the shim 262, and is pivoted about a pin 272 which is recessed within the shim 262. The ratchet member 270 is spring biased into the extended position shown in FIG. 18. However, the ratchet member 270 may be easily recessed within the shim 262 when pressure is applied to the cam surface, such as when the shim is loaded (rear-end-first) into the matching liner member 260. A supply of shims 262 jacketed within liner members 260 are loaded within the magazine 190 in the previously described manner (i.e., with the fixed pawls 200 extending forward), as shown in FIG. 16.

A modified leading shim 274 (FIG. 18) is positioned within the penetrating head 256 so that the extended ratchet member 270 contacts the trailing edge of the penetrating head 256 and the front face 198 of the leading shim contacts the flange 264 within the penetrating head. The leading shim 274 has no fixed pawls 200, and includes a slot 276 for receiving the fluid connector 268 of the penetrating head 256. Once received within the slot 276, the fluid connector 268 mates with a sealed orifice (not shown) leading to a hollow ring 278 that is fixed within the perimeter of the leading edge of the leading shim 274, as shown in FIG. 18. The hollow ring 278 includes a plurality of jeweled orifices 280 spaced evenly about the ring (FIG. 18) for directing the drilling mud after it is pumped through the hose 266 and the fluid connector 268 and into the hollow ring 278.

The operation of the vessel 254 is similar to that of the vessel 28, with the following changes. The leading shim 274 is inserted within the penetrating head 256 as described above, and the combination is positioned on the loading ram 210 during the descent of the vessel 254. As described above, the ratchet member 270 of the leading shim 274 contacts the trailing edge of the penetrating head 256 so that a rear portion of the leading shim extends to the rear of the penetrating head, thus allowing the insert ram 36 to engage the rear face 202 of the leading shim 274 and the pivotable pawls 144 to close about the pins 146 in a manner similar to the initial position of the rotary drill bit 32. Upon reaching the desired depth and extending the anchor shoes 68 and 70, the insert ram 36 is extended a predetermined distance equal to the length of the liner member 260 (and the shim 262) to push the penetrating head 256 through the round opening 130 and into the vertical shaft 22. The force applied by the insert ram 36 to the leading shim 274 is transferred to the cutting edge 258 of the penetrating head 256. Simultaneously, drilling mud is pumped through the hose 266 and transferred from the fluid connector 268 to the hollow ring 278 in the leading shim 274 where the jeweled orifices 280 direct the mud to the forward end of the borehole 34 to excavate the soil loosened by the cutting edge 258. A majority of the spent drilling mud is then channeled back through the hollow leading shim 274 to the insert ram 36 where it is directed toward the bottom of the vertical shaft 22, as described above.

After being extended the predetermined distance, the insert ram 36 is retracted and the loading ram 210 retrieves one of the shim/liner combinations from the magazine 190. As the loading ram 210 moves toward its intermediate position, the fixed pawls 200 of the shim 262 close upon the pins 146 of the leading shim 274 which protrude from behind the penetrating head 256, as described above. The insert ram 36 is then extended slightly to compress the shim 262 between the central ram portion 132 of the insert ram and the rear face 202 of the leading shim 274. The loading ram 210 then disengages from the liner member 260 surrounding the shim 262 and moves to its down position. At this point, preferably prior to further extension of the insert ram 36, the pawls 144 of the insert ram 36 are pivoted toward the closed position. However, the pawls 144 contact the liner member 260 surrounding the shim 262 and push the liner member 260 forward over the shim (FIG. 16) so that a leading edge of the liner member 260 slides over the rear portion of the leading shim 274, compressing the cam surface of the ratchet member 270, until contacting the trailing edge of the penetrating head 256. The forward movement of the liner member 260 over the shim 262 allows the pawls 144 to close over the pins 146 of the shim 262, and further allows the ratchet member 270 on the shim 262 to extend, as shown in FIG. 16. The extension of the ratchet member 270 on the shim 262 allows the ratchet member to engage the trailing edge of the liner member 260, and thus prevents the liner members 260 from being pushed backward over the moving shims 262 due to the frictional engagement between the soil and the liner members 260. The insert ram 36 then continues to push the shims 262, liner members 260 and the penetrating head 256 until it reaches its predetermined distance, at which point the cycle starts over with a new shim/liner combination.

Once the lateral borehole 34 is completed (either after a predetermined distance or after the magazine 190 has been depleted of shim/liner combinations), all the shims 262 (including the leading shim 274) may be withdrawn from the borehole 34, leaving behind only the liner members 260 and the penetrating head 256 with the attached hose 266. This is accomplished by extending the insert ram 36 and grasping the trailing shim 262 as described above. Once the "slack" between the shims 262 is removed, the insert ram 36 may pull all the shims 262 as a single line. The slot 276 in the leading shim is slidably disconnected from the fluid connector 268 on the penetrating head 256 as the line of shims 262 is retracted. Furthermore, the ratchet members 270 on the shims 262 are maintained in their recessed positions due to pressure applied to the cam surfaces by the liner members 260 as the shims 262 are pulled from the lined borehole 34 one at a time and replaced within the magazine 190.

Once all the shims 262 have been removed from the lined borehole 34, it is desirable to seal the front end of the borehole 34 to prevent the unconsolidated soil from filtering past the open penetrating head 256 and filling the string of liner members 260. Toward this end, a reservoir 282 of plug material is included within the drilling module 44 as shown in FIG. 16. A separate line 284 leads from the reservoir 282 to the hose 266 at a point downstream from a one-way valve 286 (FIG. 16). The plug material preferably comprises a ceramic two-part cement, wherein the two parts are separated by a membrane 288 within the reservoir 282. A control signal actuates a known means for expelling the mixture from the reservoir 282, rupturing the membrane 288 and mixing the two parts of the cement in the process. The plug material is then forced through the hose 266 and expelled from the fluid connector 268 on the penetrating head 256, the jeweled orifice ring 278 having already been removed from the borehole 34. The plug material then hardens quickly to seal the front end of the lined borehole.

Before releasing the anchor shoes 68 and 70 and withdrawing the vessel 254, the hose 266 must be severed to prevent it from pulling the penetrating head 256 and the liner members 260 from the borehole 34. After the plug material has been expelled, the hose guide 182 lowers the hose 266 past the knife edge 222 at the top of the round opening 130 (FIG. 16), thereby severing the hose 266 in the manner described above with respect to the first embodiment 28 of the vessel. Since the majority of the hose 266 is designed to be abandoned within the borehole 34, no spool 178 is required within the drilling module 44 of the alternative embodiment 254 of the vessel. The portion of the hose 266 remaining within the drilling module 44 may be allowed to hang out the open bottom of the drilling module as the vessel 254 is raised to the surface.

Thus, the vessel 254 simultaneously forms and lines a lateral borehole 34 in unconsolidated soils, while still retrieving all the valuable shims 262 so that they may be used again to form another borehole. Abandoning the penetrating head 256 with the liner members 260 in the borehole 34 is not wasteful since the cutting edge 258 on the penetrating head 256 would typically be dulled following the formation of the lateral borehole 34. Retrieving and refurbishing the penetrating head 256 would be cost prohibitive when compared to the cost of a new penetrating head.

Anchoring the vessel within the vertical shaft allows the insert ram 36 to develop large "weight-on-bit" drilling forces for pushing the drill string 37 and the respective drill bits. The present invention thus utilizes the strength of the medium which it is penetrating to develop a sufficient opposing drilling force for efficient penetration of the medium. This method differs from prior art drilling methods which typically rely on gravitational forces from the mass of the drill string to develop the desired weight-on-bit force. Furthermore, the method and apparatus of the present invention results in greatly increased weight-on-bit forces for lateral drilling in comparison to prior art methods.

By utilizing the preferably modular design of the shims and the drill bit, the vessel of the present invention can excavate a plurality of lateral boreholes from within one vertical shaft on a single drill string. Indeed, the vessel may combine several functions (such as coring, drilling and lining) in one trip so that time may be saved by making fewer trips between the pay zone and the surface. While space constraints within the vessel may limit the number of different functions which may be accomplished by a single vessel, it is within the scope of the present invention to stack two or more vessels together to further reduce the number of trips between the pay zone and the surface. For example, a first vessel could be used to sample (core) the suspected pay zone and penetrate the liner of the vertical shaft, while a second vessel could be used to drill and line the lateral boreholes.

The method of the present invention is superior to prior art methods because it precisely applies large drilling forces, as opposed to flexible drill strings which are necessarily limited in both their accuracy and the drilling force they can apply. Additionally, by anchoring the vessel at a depth adjacent the pay zone, no abrasive wearing action is produced (as is common with flexible rotary drill strings) which would tend to wear away the fragile formation walls of the vertical shaft. While the insert ram preferably forms lateral boreholes within the pay zone, it is within the scope of the present invention to form off-axis or angled boreholes having a vertical component in addition to a horizontal component. Off-axis boreholes of this type could be formed by using conventional gimbaling technology to angle the insert ram away (either up or down) from its preferred horizontal axis. Although boreholes may be formed with relatively large variations from the horizontal axis, the preferable off-axis variation is less than 10 degrees so that a great majority of the drilling force (approximately 98% for a 10 degree variation) is embodied in a horizontal force component which is directly countered by the wall of the vertical shaft. Lastly, the apparatus of the present invention is designed to be used with support equipment (e.g., standard drill pipe and pumps for drilling mud) which is typically used to drill the vertical shaft and which may normally be found on-site at the well.

Presently preferred embodiments of the present invention have been described with a degree of particularity. These descriptions have been made by way of preferred example and are based on a present understanding of knowledge available regarding the invention. It should be understood, however, that the scope of the present invention is defined by the following claims, and not necessarily by the detailed description of the preferred embodiments.

The invention claimed is:

1. A method of forming a substantially perpendicular borehole from within an elongated existing shaft formed in a surrounding medium, said shaft defining wall in said medium surrounding said shaft, said method comprising the steps of:

positioning an unmanned boring unit within the existing shaft;

bracing the boring unit against the wall surrounding the existing shaft to transmit forces between the boring unit and the surrounding medium; and applying a boring force from the boring unit substantially perpendicularly to the length of the elongated existing shaft to cut through the wall of the existing shaft and form the borehole in the surrounding medium.

2. A method as defined in claim 1, wherein the step of bracing the boring unit comprises extending a plurality of anchor shoes from the boring unit to contact the wall surrounding the existing shaft.

3. A method as defined in claim 2, wherein the substantially perpendicular borehole varies less than 10 degrees from an axis perpendicular to the existing shaft.

4. A method of forming a substantially lateral borehole from within an elongated substantially vertical shaft formed in a surrounding medium, said shaft defining a wall in said medium surrounding said shaft, said method comprising the steps of:

lowering an unmanned drilling unit to a predetermined depth within the vertical shaft;

bracing the drilling unit against the wall surrounding the vertical shaft to transmit forces between the drilling unit and the surrounding medium;

extending a drill string from the drilling unit to engage the wall surrounding the vertical shaft;

applying a drilling force to the drill string to cut through the wall surrounding the vertical shaft to initiate the lateral borehole; and further extending the drill string into the surrounding medium to form the lateral borehole.

5. A method as defined in claim 4, wherein the step of bracing the drilling unit comprises extending a plurality of anchor shoes from the drilling unit to contact the wall surrounding the vertical shaft.

6. A method as defined in claim 5, wherein the substantially lateral borehole varies less than 10 degrees from a lateral axis perpendicular to the substantially vertical shaft.

7. A method of forming a substantially lateral borehole from within an elongated substantially vertical shaft formed in a surrounding medium, said shaft defining a wall in said medium surrounding said shaft, said method comprising the steps of:

lowering an unmanned drilling unit to a predetermined depth within the vertical shaft;

bracing the drilling unit against the wall surrounding the vertical shaft to transmit forces between the drilling unit and the surrounding medium;

extending a drill string from the drilling unit to engage the wall surrounding the vertical shaft;

applying a drilling force to the drill string to cut through the wall surrounding the vertical shaft to initiate the lateral borehole;

further extending the drill string into the surrounding medium to form the lateral borehole; and withdrawing the drill string from the lateral borehole following completion of the borehole.

8. A method as defined in claim 7, wherein the step of bracing the drilling unit comprises extending a plurality of anchor shoes from the drilling unit to contact the wall surrounding the vertical shaft.

9. A method as defined in claim 8, wherein the substantially lateral borehole varies less than 10 degrees from a lateral axis perpendicular to the substantially vertical shaft.

10. A method as defined in claim 8, further comprising the step of accumulating within the drill string a sample of material displaced by the drill string so that the sample of material is withdrawn with the drill string.

11. A method as defined in claim 8, further comprising the step of inserting a liner within the lateral borehole following withdrawal of the drill string from the borehole.

12. A method as defined in claim 8, further comprising the step of inserting a liner within the lateral borehole simultaneous with extending the drill string and forming the borehole.

13. A method as defined in claim 8, wherein an extendable and retractable insert ram extends the drill string and applies the drilling force to the drill string.

14. A method as defined in claim 13 wherein the drill string is modular and the step of extending the drill string comprises:

positioning a drill bit in front of the insert ram;

extending the insert ram so that the drill bit cuts through the wall surrounding the vertical shaft to initiate the formation of the borehole;

retracting the insert ram;

inserting an initial drill string module between the insert ram and the drill bit;

extending the insert ram so that the drill bit expands the borehole and the initial drill string module is inserted into the borehole behind the drill bit;

cyclically retracting the insert ram, inserting additional drill string modules in front of the insert ram and extending the insert ram; and repeating the cycle until the drill string attains a predetermined length.

15. A method as defined in claim 14, wherein adjacent drill string modules within the drill string are attached to one another and the initial drill string module is attached to the drill bit, and wherein the step of withdrawing the drill string from the borehole includes:

attaching the insert ram to a rear end of the drill string;

retracting the insert ram and the attached drill string so that the drill string module adjacent the insert ram is retracted within the drilling unit;

transporting the retracted drill string module from its position in front of the insert ram to a storage rack within the drilling unit;

cyclically extending the insert ram, attaching the insert ram to the rear end of the drill string, retracting additional drill string modules and transporting the retracted drill string modules to the storage rack; and repeating the cycle until all the drill string modules are transported to the storage rack and the drill bit is retracted within the drilling unit.

16. A method as defined in claim 15 wherein a front end of the insert ram includes a pivotable pawl and the drill string modules and the drill bit include a protruding attachment pin, the step of attaching the insert ram to the rear end of the drill string comprising:

extending the insert ram until the front end of the insert ram is adjacent a drill string module at the rear end of the drill string; and lowering the pawl until it engages the attachment pin protruding from the adjacent drill string module.

17. A method as defined in claim 12, wherein an extendable and retractable insert ram extends the drill string and applies the drilling force to the drill string.

18. A method as defined in claim 17, wherein the drill string and liner are modular and the simultaneous steps of extending the drill string and inserting the liner include:

fitting a plurality of drill string modules within a plurality of liner modules to form a plurality of drill string and liner module combinations;

positioning a drill bit in front of the insert ram;

extending the insert ram so that the drill bit cuts through the wall surrounding the vertical shaft to initiate the formation of the borehole;

retracting the insert ram;

inserting a drill string and liner module combination between the insert ram and the drill bit;

extending the insert ram so that the drill bit expands the borehole and the drill string and liner module combination is inserted into the borehole behind the drill bit;

cyclically retracting the insert ram, inserting additional drill string and liner module combinations in front of the insert ram and extending the insert ram; and repeating the cycle until the drill string attains a predetermined length.

19. A method as defined in claim 18, wherein adjacent drill string modules within the drill string are attached to one another, and wherein the step of withdrawing the drill string from the borehole includes:

attaching the insert ram to a rear end of the drill string;

retracting the insert ram so that the attached drill string is withdrawn through the liner and the drill string module adjacent the insert ram is retracted within the drilling unit;

transporting the retracted drill string module from its position in front of the insert ram to a storage rack within the drilling unit;

cyclically extending the insert ram, attaching the insert ram to the rear end of the drill string, retracting additional drill string modules and transporting the retracted drill string modules to the storage rack; and repeating the cycle until all the drill string modules are transported to the storage rack.

20. A method as defined in claim 19 wherein a front end of the insert ram includes a pivotable pawl and the drill string modules include a protruding attachment pin, the step of attaching the insert ram to the rear end of the drill string comprising:

extending the insert ram until the front end of the insert ram is adjacent a drill string module at the rear end of the drill string; and lowering the pawl until it engages the attachment pin protruding from the adjacent drill string module.

21. An apparatus for forming a substantially lateral borehole from within an elongated substantially vertical shaft formed in a surrounding medium, said shaft defining a wall in said medium surrounding said shaft, said apparatus comprising an unmanned drilling unit adapted to be raised and lowered within the vertical shaft and a control system for remote operation of the drilling unit, said drilling unit including:

a selectively extendable and retractable anchor shoe adapted to brace the drilling unit against the wall surrounding the vertical shaft at a predetermined depth within the vertical shaft; and a substantially laterally extending drill string selectively extendable and retractable from within the drilling unit to cut through the wall surrounding the vertical shaft and form the borehole.

22. An apparatus as defined in claim 21 wherein said drill string includes a drill bit, said drilling unit further comprising:

a selectively extendable and retractable insert ram, said insert ram adapted to contact a rear end of the drill bit and apply a drilling force to the drill bit sufficient to penetrate the wall of the vertical shaft and the surrounding medium.

23. An apparatus as defined in claim 22 wherein:

the insert ram is selectively attachable to the rear end of the drill bit to retract the drill bit from the borehole; and the drill bit including means for retaining a sample of material displaced by the drill bit.

24. An apparatus as defined in claim 22, further comprising:

a plurality of drill string modules inserted between the insert ram and the drill bit to extend the length of the drill string.

25. An apparatus as defined in claim 24, wherein said drilling unit further comprises:

a magazine adapted to retain a stack of the drill string modules; and means for retrieving a drill string module from the magazine and aligning the drill string module with the insert ram when the insert ram is retracted.

26. An apparatus as defined in claim 24 wherein:

the drill string modules are selectively attachable to one another and to the drill bit; and said insert ram including means for selectively engaging the drill string modules and the drill bit to retract the drill string within the drilling unit upon completion of the borehole.

27. An apparatus as defined in claim 26 wherein:

the drill string modules and the drill bit include a protruding attachment pin; and said means for selectively engaging the drill string modules and the drill bit includes a selectively pivotable pawl that may be lowered to engage the protruding attachment pin on the drill string module and the drill bit and raised to release the attachment pin.

28. An apparatus as defined in claim 26, further comprising:

a plurality of liner modules adapted to be inserted into the borehole by the insert ram to form a liner within the borehole after the drill string is retracted.

29. An apparatus as defined in claim 28, wherein said drilling unit further comprises:

a magazine adapted to retain a stack of the liner modules; and means for retrieving a liner module from the magazine and aligning the liner module with the insert ram when the insert ram is retracted.

30. An apparatus as defined in claim 28 wherein the liner modules are substantially cylindrical and include openings to allow fluids outside of the liner to filter into the liner and travel to the vertical shaft.

31. An apparatus as defined in claim 30 wherein a leading liner module having a closed forward end is initially inserted into the borehole so that a forward end of the liner is closed.

32. An apparatus as defined in claim 24 wherein:

the drill string modules are selectively attachable to one another; and said insert ram including means for selectively engaging the drill string modules to retract the drill string modules within the drilling unit upon completion of the borehole.

33. An apparatus as defined in claim 32 further comprising:

a plurality of liner modules adapted to fit around the drill string modules to form a liner around the drill string within the borehole, said liner remaining within the borehole after the insert ram retracts the drill string modules.

34. An apparatus as defined in claim 33 wherein:

the liner modules are substantially cylindrical and include openings to allow fluids outside of the liner to filter into the liner and travel to the vertical shaft.

35. An apparatus as defined in claim 34 wherein the drilling unit further includes means for sealing a forward end of the liner.

* * * * *